US011408058B2

(12) United States Patent
Minami et al.

(10) Patent No.: US 11,408,058 B2
(45) Date of Patent: Aug. 9, 2022

(54) HIGH-STRENGTH STEEL SHEET AND METHOD FOR PRODUCING THE SAME

(71) Applicant: JFE STEEL CORPORATION, Tokyo (JP)

(72) Inventors: Hidekazu Minami, Tokyo (JP); Takashi Kobayashi, Tokyo (JP); Shinjiro Kaneko, Tokyo (JP); Yuji Tanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 535 days.

(21) Appl. No.: 16/485,197

(22) PCT Filed: Feb. 9, 2018

(86) PCT No.: PCT/JP2018/004515

§ 371 (c)(1),
(2) Date: Aug. 12, 2019

(87) PCT Pub. No.: WO2018/151023

PCT Pub. Date: Aug. 23, 2018

(65) Prior Publication Data

US 2019/0360081 A1 Nov. 28, 2019

(30) Foreign Application Priority Data

Feb. 15, 2017 (JP) ..... JP2017-025490

(51) Int. Cl.

| | |
|---|---|
| ***C22C 38/04*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |
| ***C22C 38/60*** | (2006.01) |
| ***C23C 2/06*** | (2006.01) |
| ***C21D 8/02*** | (2006.01) |
| ***C21D 8/04*** | (2006.01) |
| ***C21D 9/46*** | (2006.01) |

(52) U.S. Cl.

CPC ..... *C22C 38/04* (2013.01); *C21D 8/0263* (2013.01); *C21D 8/0436* (2013.01); *C21D 9/46* (2013.01); *C22C 38/001* (2013.01); *C22C 38/02* (2013.01); *C22C 38/06* (2013.01); *C22C 38/12* (2013.01); *C22C 38/14* (2013.01); *C22C 38/60* (2013.01); *C23C 2/06* (2013.01); *C21D 2211/001* (2013.01); *C21D 2211/002* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 2011/0036465 | A1 | 2/2011 | Kawasaki et al. |
| 2012/0305144 | A1 | 12/2012 | Okamoto et al. |
| 2012/0312433 | A1 | 12/2012 | Mizuta et al. |
| 2014/0242416 | A1 | 8/2014 | Matsuda et al. |
| 2017/0037488 | A1 | 2/2017 | Hasegawa et al. |
| 2017/0096723 | A1 | 4/2017 | Kasuya et al. |
| 2018/0002800 | A1 | 1/2018 | Hasegawa et al. |
| 2018/0030564 | A1 | 2/2018 | Hasegawa et al. |

FOREIGN PATENT DOCUMENTS

| | | | |
|---|---|---|---|
| CN | 105189804 | A | 12/2015 |
| CN | 105452513 | A | 3/2016 |
| CN | 105579606 | A | 5/2016 |
| CN | 106103768 | A | 11/2016 |
| EP | 2202327 | A1 | 6/2010 |
| EP | 2258886 | A1 | 12/2010 |
| EP | 2921568 | A1 | 9/2015 |
| EP | 2921569 | A1 | 9/2015 |
| EP | 2980243 | A1 | 2/2016 |
| EP | 3012339 | A1 | 4/2016 |
| EP | 3050988 | A1 | 8/2016 |
| EP | 3178949 | A1 | 6/2017 |
| EP | 3178955 | A1 | 6/2017 |
| JP | 2009-209451 | A | 9/2009 |
| JP | 2012237042 | A | 12/2012 |
| JP | 2013-227624 | A | 11/2013 |
| JP | 5369663 | B2 | 12/2013 |
| JP | 2015-081359 | A | 4/2015 |

(Continued)

OTHER PUBLICATIONS

Dec. 17, 2020 Notice of Allowance issued in Korean Application No. 10-2019-7023742.

May 1, 2018 International Search Report issued in International Patent Application No. PCT/JP2018/004515.

Dec. 20, 2019 Extended Search Report issued in European Patent Application No. 18754114.9.

(Continued)

*Primary Examiner* — Anthony M Liang

(74) *Attorney, Agent, or Firm* — Oliff PLC

(57) ABSTRACT

There is provided a high-strength steel sheet and a method for producing the same. The steel sheet has a specified chemical composition and a microstructure including, in terms of area percentage, 20.0% or more and 60.0% or less ferrite, 40.0% or more and 80.0% or less of a hard phase composed of bainitic ferrite, tempered martensite, fresh martensite, and retained austenite, 35.0% or more and 55.0% or less bainitic ferrite with respect to the entire hard phase, 20.0% or more and 40.0% or less tempered martensite with respect to the entire hard phase, 3.0% or more and 15.0% or less fresh martensite with respect to the entire hard phase, and 5.0% or more and 20.0% or less retained austenite with respect to the entire hard phase.

20 Claims, No Drawings

(56) References Cited

FOREIGN PATENT DOCUMENTS

| | | | |
|---|---|---|---|
| JP | 5888471 | B1 | 3/2016 |
| JP | 5943156 | B1 | 6/2016 |
| JP | 5-967319 | B2 | 8/2016 |
| KR | 10-2010-0046057 | A | 5/2010 |
| KR | 10-2010-0092503 | A | 8/2010 |
| WO | 2013/051238 | A1 | 4/2013 |
| WO | 2016/113788 | A1 | 7/2016 |
| WO | 2016/113789 | A1 | 7/2016 |

OTHER PUBLICATIONS

Oct. 12, 2020 Office Action issued in Chinese Patent Application No. 201880011403.2.

HIGH-STRENGTH STEEL SHEET AND METHOD FOR PRODUCING THE SAME

This application relates to a high-strength steel sheet mainly suitable for automotive structural members and a method for producing the high-strength steel sheet.

BACKGROUND

With increasing concern about environmental problems, $CO_2$ emission regulations have recently been tightened. In the field of automobiles, reductions in the weight of automobile bodies for increasing fuel efficiency are issues to be addressed. Thus, progress has been made in reducing the thickness of automobile parts by using a high-strength steel sheet for automobile parts. In particular, there is a growing trend toward using a steel sheet having a tensile strength (TS) of 980 MPa or more.

High-strength steel sheets used for structural members and reinforcing members of automobiles are required to have good workability. In particular, a high-strength steel sheet used for parts having complex shapes is required not only to have characteristics such as good ductility (hereinafter, also referred to as "elongation") or good stretch-flangeability (hereinafter, also referred to as "hole expansion formability") but also to have both good ductility and good stretch-flangeability.

Additionally, automobile parts such as structural members and reinforcing members are required to have good collision energy absorption characteristics. The control of the yield ratio (YR=YS/TS) of the steel sheet serving as a material is effective in improving the collision energy absorption characteristics of automobile parts. The control of the yield ratio (YR) of the high-strength steel sheet enables the reduction of springback after forming the steel sheet into a shape and an increase in collision energy absorption at the time of collision.

To deal with these requests, for example, Patent Literature 1 discloses a high-yield-ratio high-strength cold-rolled steel sheet having a steel composition containing, by mass, C: 0.15% to 0.25%, Si: 1.2% to 2.2%, Mn: 1.8% to 3.0%, P: 0.08% or less, S: 0.005% or less, Al: 0.01% to 0.08%, N: 0.007% or less, Ti: 0.005% to 0.050%, and B: 0.0003% to 0.0050%, the balance being Fe and incidental impurities, the steel sheet having a composite microstructure having a ferrite volume fraction of 20% to 50%, a retained austenite volume fraction of 7% to 20%, and a martensite volume fraction of 1% to 8%, the balance being bainite and tempered martensite, in which in the composite microstructure, ferrite has an average grain size of 5 μm or less, retained austenite has an average grain size of 0.3 to 2.0 μm and an aspect ratio of 4 or more, martensite has an average grain size of 2 μm or less, a metal phase consisting of bainite and tempered martensite has an average grain size of 7 μm or less, the volume fraction (V1) of a metal structure excluding ferrite and the volume fraction (V2) of tempered martensite satisfy expression (1), and retained austenite has an average C concentration of 0.65% or more by mass.

$$0.60 \leq V2/V1 \leq 0.85 \ldots \quad (1)$$

Patent Literature 2 discloses a high-strength galvanized steel sheet having good workability and containing, by mass, C: 0.05% to 0.3%, Si: 0.01% to 2.5%, Mn: 0.5% to 3.5%, P: 0.003% to 0.100%, S: 0.02% or less, and Al: 0.010% to 1.5%, the total amount of Si and Al added being 0.5% to 2.5%, the balance being iron and incidental impurities, in which the high-strength galvanized steel sheet has a microstructure containing, by area, 20% or more of a ferrite phase, 10% or less (including 0%) of a martensite phase, and 10% or more and 60% or less of a tempered martensite phase, and containing, by volume, 3% or more and 10% or less of a retained austenite phase, in which the retained austenite phase has an average grain size of 2.0 μm or less.

CITATION LIST

Patent Literature

PTL 1: Japanese Patent No. 5888471
PTL 2: Japanese Patent No. 5369663

SUMMARY

Technical Problem

Although the high-strength steel sheet described in Patent Literature 1 has good workability, in particular, good elongation and good stretch-flangeability, the yield ratio is as high as 76% or more. In the high-strength steel sheet described in Patent Literature 2, as disclosed in Tables 1 to 3, when a tensile strength of 980 MPa or more, sufficient ductility, and sufficient stretch-flangeability are ensured, Nb, Ca, and so forth need to be contained.

In light of the circumstances described above, the disclosed embodiments aim to provide a high-strength steel sheet particularly having a tensile strength (TS) of 980 MPa or more, a yield ratio (YR) of 55% to 75%, good ductility, and good stretch-flangeability, and a method for producing the high-strength steel sheet.

Solution to Problem

To overcome the foregoing problems, the inventors have conducted intensive studies to obtain a high-strength steel sheet having a tensile strength (TS) of 980 MPa or more, a yield ratio (YR) of 55% to 75%, good ductility, and good stretch-flangeability, and a method for producing the high-strength steel sheet and have found the following.

(1) The ductility is improved by setting the area percentage of ferrite to 20.0% to 60.0% to finely disperse retained austenite and controlling the C content of the retained austenite, and (2) the stretch-flangeability is improved by using tempered martensite having a hardness between the ferrite and the tempered martensite and appropriately controlling the C content of each of the tempered martensite and fresh martensite.

These findings have led to the completion of the disclosed embodiments. The gist of these embodiments is described below.

[1] A high-strength steel sheet has a component composition containing, by mass, C: 0.12% or more and 0.28% or less, Si: 0.80% or more and 2.20% or less, Mn: 1.50% or more and 3.00% or less, P: 0.001% or more and 0.100% or less, S: 0.0200% or less, Al: 0.010% or more and 1.000% or less, and N: 0.0005% or more and 0.0100% or less, the balance being Fe and incidental impurities; and a steel microstructure containing 20.0% or more and 60.0% or less ferrite in terms of area percentage, 40.0% or more and 80.0% or less of a hard phase composed of bainitic ferrite, tempered martensite, fresh martensite, and retained austenite in terms of total area percentage, 35.0% or more area and 55.0% or less bainitic ferrite with respect to the entire hard phase in terms of area percentage, 20.0% or more and 40.0% or less tempered martensite with respect to the entire hard phase in terms of area percentage, 3.0% or more and 15.0% or less fresh martensite with respect to the entire hard phase in terms of area percentage, and 5.0% or more and 20.0% or less retained austenite with respect to the entire hard phase in terms of area percentage, in which the retained austenite has a C content of 0.6% or more by mass, the ratio of the C content of the tempered martensite to the C content of the fresh martensite is 0.2 or more and less than 1.0, the high-strength steel sheet has a tensile strength (TS) of 980 MPa or more and a yield ratio (YR) of 55% to 75%, the high-strength steel sheet has a tensile strength (TS) of 980 MPa or more and a yield ratio (YR) of 55% to 75%, in which the product (TS×El) of the tensile strength (TS) and the total elongation (El) is 23,500 MPa·% or more, and the product (TS×λ) of the tensile strength (TS) and the hole expansion ratio (λ) is 24,500 MPa·% or more.

[2] In the steel microstructure of the high-strength steel sheet according to [1], the retained austenite has an average grain size of 0.2 μm or more and 5.0 μm or less.

[3] In the high-strength steel sheet according to [1] or [2], the component composition further contains, by mass, at least one selected from Ti: 0.001% or more and 0.100% or less, Nb: 0.001% or more and 0.100% or less, V: 0.001% or more and 0.100% or less, B: 0.0001% or more and 0.0100% or less, Mo: 0.01% or more and 0.50% or less, Cr: 0.01% or more and 1.00% or less, Cu: 0.01% or more and 1.00% or less, Ni: 0.01% or more and 0.50% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

[4] The high-strength steel sheet according to any one of [1] to [3], further contains a coated layer on a surface of the steel sheet.

[5] A method for producing the high-strength steel sheet according to any one of [1] to [3] includes, in sequence, heating steel, performing hot rolling at a rolling reduction in the final pass of a finish rolling of 5% or more and 15% or less and at a finish rolling delivery temperature of 800° C. or higher and 1,000° C. or lower, performing coiling at a coiling temperature of 600° C. or lower, performing cold rolling, and performing annealing, in which letting a temperature defined by formula (1) be temperature Ta (° C.) and letting a temperature defined by formula (2) be temperature Tb (° C.), the annealing includes, in sequence, retaining heat at a heating temperature of 720° C. or higher and temperature Ta or lower for 10 s or more, performing cooling to a cooling stop temperature of (temperature Tb−100° C.) or higher and temperature Tb or lower at an average cooling rate of 10° C./s or more in a temperature range of 600° C. to the heating temperature, performing reheating to A or higher and 560° C. or lower (where A is a freely-selected temperature (° C.) that satisfies 350° C.≤A≤450° C.), and performing holding at a holding temperature (A) of 350° C. or higher and 450° C. or lower for 10 s or more, $$\text{temperature Ta (° C.)}=946-203\times[\%\ C]^{1/2}+45\times[\%\ Si]-30\times[\%\ Mn]+150\times[\%\ Al]-20\times[\%\ Cu]+11\times[\%\ Cr]+400\times[\%\ Ti]\ \ldots \quad (1)$$

where [% X] indicates the component element X content (% by mass) of steel and is 0 if X is not contained, and $$\text{temperature Tb (° C.)}=435-566\times[\%\ C]-150\times[\%\ C]\times[\%\ Mn]-7.5\times[\%\ Si]+15\times[\%\ Cr]-67.6\times[\%\ C]\times[\%\ Cr]\ \ldots \quad (2)$$

where [% X] indicates the component element X content (% by mass) of steel and is 0 if X is not contained.

[6] The method for producing the high-strength steel sheet according to [5], after the coiling, a heat treatment that includes performing holding in a heat treatment temperature range of 450° C. to 650° C. for 900 s or more is performed.

[7] The method for producing the high-strength steel sheet according to [5] or [6], a coating treatment is performed after the annealing.

In the disclosed embodiments, the "high-strength steel sheet" refers to a steel sheet having a tensile strength (TS) of 980 MPa or more and includes a cold-rolled steel sheet and a steel sheet obtained by subjecting a cold-rolled steel sheet to surface treatment such as coating treatment or coating alloying treatment. In the disclosed embodiments, the value of the yield ratio (YR), which serves as an index of the controllability of the yield stress (YS), is 55% or more and 75% or less. YR is determined by formula (3):

$$YR=YS/TS\ \ldots \quad (3)$$

In the disclosed embodiments, "good ductility", i.e., "good total elongation (El)" indicates that the value of TS×El is 23,500 MPa·% or more. In the disclosed embodiments, "good stretch-flangeability" indicates that the value of TS×λ is 24,500 MPa·% or more, where λ is the value of a critical hole-expansion ratio (hereinafter, also referred to as a "hole expansion ratio"), which serves as an index of the stretch-flangeability.

Advantageous Effects

According to the disclosed embodiments, the high-strength steel sheet having a tensile strength (TS) of 980 MPa or more, a yield ratio (YR) of 55% to 75%, good ductility, and good stretch-flangeability is effectively obtained. The use of the high-strength steel sheet, obtained by the production method of the disclosed embodiments, for, for example, automotive structural members reduces the weight of automobile bodies to contribute greatly to an improvement in fuel economy; thus, the high-strength steel sheet has a very high industrial utility value.

DETAILED DESCRIPTION

The disclosed embodiments will be described in detail below.

The component composition of a high-strength steel sheet of the disclosed embodiments and the reason for the limitation will be described below. In the following description, "%" that expresses the component composition of steel refers to "% by mass" unless otherwise specified.

C: 0.12% or More and 0.28% or Less

C is one of the important basic components of steel. In particular, in the disclosed embodiments, C is an important element that affects fractions (area percentages) of bainitic ferrite, tempered martensite, fresh martensite (as-quenched martensite), and retained austenite after annealing. The mechanical characteristics such as the strength (TS and YS), the ductility, and the hole expansion formability of the resulting steel sheet vary greatly, depending on the fractions (area percentages) of the bainitic ferrite, tempered martensite, and the fresh martensite. In particular, the ductility varies greatly, depending on the fractions (area percentages) of ferrite and the retained austenite and the C content of the retained austenite. Additionally, YR and λ vary greatly, depending on the ratio of the C content of the tempered martensite to the C content of the fresh martensite. A C content of less than 0.12% results in a decrease in retained austenite fraction, thereby decreasing the ductility of the steel sheet. Furthermore, the C contents of the tempered martensite and the fresh martensite are decreased to soften the hard phase, thereby decreasing TS. A C content of more than 0.28% results in an increase in the C content of the tempered martensite and the fresh martensite, thereby increasing TS. However, the fraction of the fresh martensite is increased to decrease the elongation and the stretch-flangeability. Accordingly, the C content is 0.12% or more and 0.28% or less, preferably 0.15% or more, preferably 0.25% or less, more preferably 0.16% or more, more preferably 0.24% or less.

Si: 0.80% or More and 2.20% or Less

Si is an important element to improve the ductility of the steel sheet by inhibiting the formation of carbide and promoting the formation of the retained austenite. Additionally, Si is also effective in inhibiting the formation of carbide due to the decomposition of the retained austenite. Furthermore, Si has a high solid-solution strengthening ability in the ferrite to contribute to an improvement in the strength of steel. Si dissolved in the ferrite is effective in improving the work hardening ability to increase the ductility of the ferrite itself. At a Si content of less than 0.80%, a desired area percentage of the retained austenite cannot be ensured, thereby decreasing the ductility of the steel sheet. Additionally, the solid-solution strengthening by Si cannot be utilized, thereby decreasing TS. Furthermore, the area percentage of the tempered martensite is increased to decrease the area percentage of the fresh martensite, thereby increasing the yield ratio (YR). At a Si content of more than 2.20%, the ferrite grows during cooling in annealing to increase the area percentage of the ferrite. This increases the hardness of the fresh martensite, thereby decreasing YR and the hole expansion ratio ($\lambda$). Accordingly, the Si content is 0.80% or more and 2.20% or less, preferably 1.00% or more, preferably 2.00% or less, more preferably 1.10% or more, more preferably 1.80% or less.

Mn: 1.50% or More and 3.00% or Less

Mn is effective in ensuring the strength of the steel sheet. Additionally, Mn improves the hardenability and thus inhibits the formation of pearlite and bainite during the cooling in the annealing, thereby facilitating transformation from austenite to martensite. A Mn content of less than 1.50% results in the formation of bainite during the cooling in the annealing, thereby increasing YR and decreasing the ductility. A Mn content of more than 3.00% results in the inhibition of ferrite transformation during the cooling. This increases the area percentage of the hard phase after the annealing, thereby increasing TS and decreasing YR and the total elongation (El). Accordingly, the Mn content is 1.50% or more and 3.00% or less, preferably 1.60% or more, preferably 2.90% or less, more preferably 1.70% or more, more preferably 2.80% or less.

P: 0.001% or More and 0.100% or Less

P is an element that has a solid-solution strengthening effect and can be contained, depending on desired strength. To provide these effects, the P content needs to be 0.001% or more. At a P content of more than 0.100%, P segregates at grain boundaries of austenite to embrittle the grain boundaries, thereby decreasing the local elongation to decrease the total elongation and the stretch-flangeability. Furthermore, the weldability is degraded. Additionally, when a galvanized coating is subjected to alloying treatment (galvannealing treatment), the alloying rate is markedly slowed to degrade the coating quality. Accordingly, the P content is 0.001% or more and 0.100% or less, preferably 0.005% or more, preferably 0.050% or less.

S: 0.0200% or Less

S segregates at grain boundaries to embrittle steel during hot rolling and is present in the form of a sulfide to decrease the local deformability, the ductility, and the stretch-flangeability. Thus, the S content needs to be 0.0200% or less. The lower limit of the S content is not particularly limited. However, because of the limitation of the production technology, the S content is preferably 0.0001% or more. Accordingly, the S content is 0.0200% or less, preferably 0.0001% or more, preferably 0.0100% or less, more preferably 0.0003% or more, more preferably 0.0050% or less.

Al: 0.010% or More and 1.000% or Less

Al is an element that can inhibit the formation of carbide during the cooling step in the annealing and that can promote the formation of martensite, and is effective in ensuring the strength of the steel sheet. To provide these effects, the Al content needs to be 0.010% or more. An Al content of more than 1.000% results in a large number of inclusions in the steel sheet. This decreases the local deformability to decrease the ductility. Accordingly, the Al content is 0.010% or more and 1.000% or less, preferably 0.020% or more, preferably 0.500% or less.

N: 0.0005% or More and 0.0100% or Less

N binds to Al to form AlN. When B is contained, N binds to B to form BN. A high N content results in the formation of a large amount of coarse nitride, thereby decreasing the local deformability. This decreases the ductility and the stretch-flangeability. Thus, the N content is 0.0100% or less in the disclosed embodiments. Because of the limitation of the production technology, the N content needs to be 0.0005% or more. Accordingly, the N content is 0.0005% or more and 0.0100% or less, preferably 0.0010% or more, preferably 0.0070% or less, more preferably 0.0015% or more, more preferably 0.0050% or less.

The balance is iron (Fe) and incidental impurities. However, O may be contained in an amount of 0.0100% or less to the extent that the advantageous effects of the disclosed embodiments are not impaired.

The steel sheet of the disclosed embodiments contains these essential elements described above and thus has the intended characteristics. In addition to the essential elements, the following elements can be contained as needed. At Least one Selected from Ti: 0.001% or more and 0.100% or less, Nb: 0.001% or more and 0.100% or less, V: 0.001% or more and 0.100% or less, B: 0.0001% or more and 0.0100% or less, Mo: 0.01% or more and 0.50% or less, Cr: 0.01% or more and 1.00% or less, Cu: 0.01% or more and 1.00% or less, Ni: 0.01% or more and 0.50% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, REM: 0.0001% or more and 0.0200% or less Ti, Nb, and V form fine carbides, nitrides, or carbonitrides during the hot rolling or annealing to increase the strength of the steel sheet. To provide the effect, each of the Ti content, the Nb content, and the V content need to be 0.001% or more. If each of the Ti content, the Nb content, and the V content is more than 0.100%, large amounts of coarse carbides, nitrides, or carbonitrides are precipitated in ferrite, which serves as a matrix phase, substructures of tempered martensite and fresh martensite, or grain boundaries of prior austenite, thereby decreasing the local deformability to decrease the ductility and the stretch-flangeability. Accordingly, when Ti, Nb, and V are contained, each of the Ti content, the Nb content, and the V content is preferably 0.001% or more and 0.100% or less, more preferably 0.005% or more, more preferably 0.050% or less.

B is an element that can improve the hardenability without decreasing the martensitic transformation start temperature. Additionally, B can inhibit the formation of pearlite and bainite during the cooling in the annealing to facilitate the transformation from austenite to martensite. To provide the effects, the B content needs to be 0.0001% or more. A B content of more than 0.0100% results in the formation of cracks in the steel sheet during the hot rolling, thereby greatly decreasing the ductility. Furthermore, the stretch-flangeability is also decreased. Accordingly, when B is contained, the B content is preferably 0.0001% or more and 0.0100% or less, more preferably 0.0003% or more, more preferably 0.0050% or less, even more preferably 0.0005% or more, even more preferably 0.0030% or less.

Mo is an element that can improve the hardenability. Additionally, Mo is an element effective in forming tempered martensite and fresh martensite. The effects are provided at a Mo content of 0.01% or more. However, even if the Mo content is more than 0.50%, it is difficult to further provide the effects. Additionally, for example, inclusions are increased to cause defects and so forth on the surfaces and in the steel sheet, thereby greatly decreasing the ductility. Accordingly, when Mo is contained, the Mo content is preferably 0.01% or more and 0.50% or less, more preferably 0.02% or more, more preferably 0.35% or less, even more preferably 0.03% or more, even more preferably 0.25% or less.

Cr and Cu serve as solid-solution strengthening elements and, in addition, stabilize austenite and facilitate the formation of tempered martensite and fresh martensite during the cooling in the annealing, during the heating, and during a cooling step in cooling treatment of a cold-rolled steel sheet. To provide the effects, each of the Cr content and the Cu content needs to be 0.01% or more. If each of the Cr content and the Cu content is more than 1.00%, cracking of surface layers may occur during the hot rolling. Additionally, for example, inclusions are increased to cause defects and so forth on the surfaces and in the steel sheet, thereby greatly decreasing the ductility. Furthermore, the stretch-flangeability is also decreased. Accordingly, when Cr and Cu are contained, each of the Cr content and the Cu content is preferably 0.01% or more and 1.00% or less, more preferably 0.05% or more, more preferably 0.80% or less.

Ni is an element that contributes to an increase in strength owing to solid-solution strengthening and transformation strengthening. To provide the effect, Ni needs to be contained in an amount of 0.01% or more. An excessive Ni content may cause the surface layers to be cracked during the hot rolling and increases, for example, inclusions to cause defects and so forth on the surfaces and in the steel sheet, thereby greatly decreasing the ductility. Furthermore, the stretch-flangeability is also decreased. Accordingly, when Ni is contained, the Ni content is preferably 0.01% or more and 0.50% or less, more preferably 0.05% or more, more preferably 0.40% or less.

As is an element effective in improving the corrosion resistance. To provide the effect, As needs to be contained in an amount of 0.001% or more. An excessive As content results in the promotion of hot shortness and the increase of, for example, inclusions. This causes defects and so forth on the surfaces and in the steel sheet, thereby greatly decreasing the ductility. Furthermore, the stretch-flangeability is also decreased. Accordingly, when As is contained, the As content is preferably 0.001% or more and 0.500% or less, more preferably 0.003% or more, more preferably 0.300% or less.

Sb and Sn may be contained as needed from the viewpoint of inhibiting decarbonization in regions extending from the surfaces of the steel sheet to positions several tens of micrometers from the surfaces in the thickness direction, the decarbonization being caused by nitridation or oxidation of the surfaces of the steel sheet. The inhibition of the nitridation and the oxidation prevents a decrease in the amount of martensite formed on the surfaces of the steel sheet and is thus effective in ensuring the strength of the steel sheet. To provide the effect, each of the Sb content and the Sn content needs to be 0.001% or more. If each of Sb and Sn is excessively contained in an amount of more than 0.200%, the ductility is decreased. Accordingly, when Sb and Sn are contained, each of the Sb content and the Sn content is preferably 0.001% or more and 0.200% or less, more preferably 0.002% or more, more preferably 0.150% or less.

Ta is an element that forms alloy carbides and alloy carbonitrides to contribute to an increase in strength, as well as Ti and Nb. Additionally, Ta is partially dissolved in Nb carbide and Nb carbonitride to form a complex precipitate such as (Nb, Ta) (C, N) and thus to significantly inhibit the coarsening of precipitates, so that Ta is seemingly effective in stabilizing the percentage contribution to an improvement in the strength of the steel sheet through precipitation strengthening. Thus, Ta is preferably contained as needed. The precipitation-stabilizing effect is provided at a Ta content of 0.001% or more. Even if Ta is excessively contained, the precipitation-stabilizing effect is saturated. Furthermore, for example, the inclusions are increased to cause defects and so forth on the surfaces and in the steel sheet, thereby greatly decreasing the ductility. Furthermore, the stretch-flangeability is also decreased. Accordingly, when Ta is contained, the Ta content is preferably 0.001% or more and 0.100% or less, more preferably 0.002% or more, more preferably 0.080% or less.

Ca and Mg are elements that are used for deoxidation and that are effective in spheroidizing the shape of sulfides to improve the adverse effect of sulfides on the ductility, in particular, the local deformability. To provide the effects, each of the Ca content and the Mg content needs to be 0.0001% or more. If each of the Ca content and the Mg content is more than 0.0200%, for example, inclusions are increased to cause defects and so forth on the surfaces and in the steel sheet, thereby greatly decreasing the ductility. Furthermore, the stretch-flangeability is also decreased. Accordingly, when Ca and Mg are contained, each of the Ca content and the Mg content is preferably 0.0001% or more and 0.0200% or less, more preferably 0.0002% or more, more preferably 0.0100% or less.

Each of Zn, Co, and Zr is an element effective in spheroidizing the shape of sulfides to improve the adverse effect of sulfides on the local deformability and the stretch-flangeability. To provide the effects, each of the Zn content, the Co content, and the Zr content needs to be 0.001% or more. If each of the Zn content, the Co content, and the Zr content is more than 0.020%, for example, inclusions are increased to cause defects and so forth on the surfaces and in the steel sheet, thereby decreasing the ductility and the stretch-flangeability. Accordingly, when Zn, Co, and Zr are contained, each of the Zn content, the Co content, and the Zr content is preferably 0.001% or more and 0.020% or less, more preferably 0.002% or more, more preferably 0.015% or less.

REM is an element in effective in improving the strength and the corrosion resistance. To provide the effects, the REM content needs to be 0.0001% or more. However, if the REM content is more than 0.0200%, for example, inclusions are increased to cause defects and so forth on the surfaces and in the steel sheet, thereby decreasing the ductility and the stretch-flangeability. Accordingly, when REM is contained, the REM content is preferably 0.0001% or more and 0.0200% or less, more preferably 0.0005% or more, more preferably 0.0150% or less.

The steel microstructure, which is an important factor of the high-strength steel sheet of the disclosed embodiments, will be described below. The area percentage described below refers to an area percentage with respect to the entire microstructure of the steel sheet.

Area Percentage of Ferrite: 20.0% or More and 60.0% or Less

In the disclosed embodiments, this is a significantly important constituent feature. The control of the amount of ferrite to a predetermined value is effective in improving the ductility while desired strength in the disclosed embodiments is ensured. If the area percentage of the ferrite is less than 20.0%, the area percentage of the hard phase described below is increased, thus increasing YR and decreasing the ductility. If the area percentage of the ferrite is more than 60.0%, YR and the hole expansion formability are decreased. Additionally, the area percentage of the retained austenite is decreased to decrease the ductility. Accordingly, the area percentage of the ferrite is 20.0% or more and 60.0% or less, preferably 23.0% or more, preferably 55.0% or less, more preferably 25.0% or more, more preferably 50.0% or less. The area percentage of the ferrite can be measured by a method described in examples below.

Area Percentage of Hard Phase: 40.0% or More and 80.0% or Less

The hard phase in the disclosed embodiments includes bainitic ferrite, tempered martensite, fresh martensite, and retained austenite. If the total of the area percentages of the structures constituting the hard phase is less than 40.0%, YR and the hole expansion formability are decreased. Additionally, the area percentage of the retained austenite is decreased to decrease the ductility. If the total of the area percentages of the structures constituting the hard phase is more than 80.0%, YR is increased, and the ductility is decreased. Accordingly, the area percentage of the hard phase is 40.0% or more and 80.0% or less, preferably 45.0% or more, preferably 75.0% or less, more preferably 49.0% or more, more preferably 73.0% or less.

In the disclosed embodiments, it is important to set the area percentages of the bainitic ferrite, the tempered martensite, the fresh martensite, and the retained austenite in ranges described below with respect to the entire hard phase.

Area Percentage of Bainitic Ferrite with Respect to Entire Hard Phase: 35.0% or More and 55.0% or Less In the disclosed embodiments, this is a significantly important constituent feature. First, bainitic ferrite will be described. Bainite is composed of bainitic ferrite and carbide. Bainite is classified into upper bainite and lower bainite on a transformation temperature range basis. Upper bainite and lower bainite, into which bainite is classified on the basis of the transformation temperature range, are distinguished from each other by the presence or absence of regularly arranged fine carbide in bainitic ferrite. Bainitic ferrite in the disclosed embodiments refers to bainitic ferrite included in upper bainite. In upper bainite, retained austenite and/or carbide is formed between bainitic ferrite grains when lath-shaped bainitic ferrite is formed. Thus, an increase in the area percentage of bainitic ferrite with respect to the entire hard phase is required in order to obtain retained austenite that contributes to an improvement in ductility. C can be concentrated in untransformed austenite when bainitic ferrite is formed; thus, bainitic ferrite contributes to an increase in the C content of the retained austenite after annealing. If the area percentage of the bainitic ferrite is less than 35.0% with respect to the entire hard phase, the area percentage of the retained austenite is decreased to decrease the ductility. If the area percentage of the bainitic ferrite is more than 55.0% with respect to the entire hard phase, the C concentration in the hard phase is decreased to decrease the hardness of the hard phase, thereby decreasing TS. Accordingly, the area percentage of the bainitic ferrite with respect to the entire hard phase is 35.0% or more and 55.0% or less, preferably 36.0% or more and 50.0% or less. The area percentage of the bainitic ferrite can be measured by a method described in the examples below.

Area Percentage of Tempered Martensite with Respect to Entire Hard Phase: 20.0% or More and 40.0% or Less In the disclosed embodiments, this is a significantly important constituent feature. The formation of tempered martensite enables desired hole expansion formability to be ensured while desired strength is achieved. If the area percentage of the tempered martensite is less than 20.0% with respect to the entire hard phase, the area percentage of the fresh martensite is increased to decrease YR and the hole expansion formability. If the area percentage of the tempered martensite is more than 40.0% with respect to the entire hard phase, YR is increased. However, the area percentage of the retained austenite is decreased to decrease the ductility. Accordingly, the area percentage of the tempered martensite with respect to the entire hard phase is 20.0% or more and 40.0% or less, preferably 25.0% or more and 39.0% or less. The area percentage of the tempered martensite can be measured by a method described in the examples below.

Area Percentage of Fresh Martensite with Respect to Entire Hard Phase: 3.0% or More and 15.0% or Less In the disclosed embodiments, this is a significantly important constituent feature. The formation of fresh martensite enables the control of YR. To provide the effect, the area percentage of the fresh martensite needs to be 3.0% or more. If the area percentage of the fresh martensite is less than 3.0% with respect to the entire hard phase, the fraction of the tempered martensite is increased to increase YR. If the area percentage of the fresh martensite is more than 15.0% with respect to the entire hard phase, the area percentage of the retained austenite is decreased to decrease the ductility and the stretch-flangeability. Accordingly, the area percentage of the fresh martensite with respect to the entire hard phase is 3.0% or more and 15.0% or less, preferably 3.0% or more and 12.0% or less. The area percentage of the fresh martensite can be measured by a method described in the examples below.

Area Percentage of Retained Austenite with Respect to Entire Hard Phase: 5.0% or More and 20.0% or Less In the disclosed embodiments, this is a significantly important constituent feature. To ensure a good balance between the strength and the ductility, the area percentage of retained austenite needs to be 5.0% or more. If the volume percentage of the retained austenite is more than 20.0%, the grain size of the retained austenite is increased to degrade the punching characteristics, thereby decreasing the hole expansion formability. Accordingly, the area percentage of the retained austenite with respect to the entire hard phase is 5.0% or more and 20.0% or less, preferably 7.0% or more, preferably 18.0% or less, more preferably 16.0% or less. The area percentage of the retained austenite can be measured by a method described in the examples below.

Average Grain Size of Retained Austenite: 0.2 μm or More and 5.0 μm or Less (Preferred Condition)

The retained austenite, which can achieve good ductility and a good balance between the strength (TS) and the ductility, is transformed into martensite during punching work to form cracks at boundaries with ferrite, thereby decreasing the hole expansion formability. This problem can be remedied by reducing the average grain size of the retained austenite to 5.0 μm or less. If the retained austenite has an average grain size of more than 5.0 μm, the retained austenite is subjected to martensitic transformation at the early stage of work hardening during tensile deformation, thereby decreasing the ductility. If the retained austenite has an average grain size of less than 0.2 μm, the retained austenite is not subjected to martensitic transformation even at the late stage of the work hardening during the tensile deformation. Thus, the retained austenite contributes less to the ductility, making it difficult to ensure desired El. Accordingly, the retained austenite preferably has an average grain size of 0.2 μm or more and 5.0 μm or less, more preferably 0.3 μm or more, more preferably 2.0 μm or less. The average grain size of the retained austenite can be measured by a method described in the examples below.

C Content of Retained Austenite: 0.6% or More by Mass

In the disclosed embodiments, this is a significantly important constituent feature. To achieve a good balance between the strength and the ductility, the retained austenite needs to have a C content of 0.6% or more by mass. If the retained austenite has a C content of less than 0.6% by mass, the retained austenite is subjected to martensitic transformation at the early stage of work hardening during tensile deformation, thereby decreasing the ductility. The upper limit of the C content of the retained austenite is not particularly limited. However, if the retained austenite has a C content of more than 1.5% by mass, the punching characteristics and the hole expansion formability may be degraded. Additionally, the retained austenite is not subjected to martensitic transformation even at the late stage of the work hardening during the tensile deformation. Thus, the retained austenite contributes less to the ductility, making it difficult to ensure desired El. Accordingly, the retained austenite has a C content of 0.6% or more by mass, preferably 0.6% or more by mass and 1.5% or less by mass. The C content of the retained austenite can be measured by a method described in the examples below.

Ratio of C Content of Tempered Martensite to C Content of Fresh Martensite: 0.2 or More and Less than 1.0

In the disclosed embodiments, this is a significantly important constituent feature. The C content of the fresh martensite and the C content of the tempered martensite correlate with a difference in hardness between the structures. The appropriate control of the ratio of the C content of the tempered martensite to the C content of the fresh martensite can improve the hole expansion formability while desired YR is ensured. If the ratio of the C content of the tempered martensite to the C content of the fresh martensite is less than 0.2, the difference in hardness between the fresh martensite and the tempered martensite is increased to degrade the hole expansion formability. Furthermore, YR is decreased. If the ratio of the C content of the tempered martensite to the C content of the fresh martensite is 1.0 or more, the hardness of the tempered martensite is comparable to that of the fresh martensite. Thus, a phase having a hardness between the ferrite and the fresh martensite is not present, thereby degrading the hole expansion formability. Accordingly, the ratio of the C content of the tempered martensite to the C content of the fresh martensite is 0.2 or more and less than 1.0, preferably 0.2 or more and 0.9 or less. The C content of the fresh martensite and the C content of the tempered martensite can be measured by a method described in the examples below.

In the steel microstructure according to the disclosed embodiments, when pearlite, carbides such as cementite, and any known structure of steel sheets are contained in addition to the ferrite, the bainitic ferrite, the tempered martensite, the fresh martensite, and the retained austenite described above, the advantageous effects of the disclosed embodiments are not impaired as long as the pearlite, the carbides, and any known structures of steel sheets are contained in a total area percentage of 3.0% or less.

A method for producing a high-strength steel sheet of the disclosed embodiments will be described below.

The high-strength steel sheet of the disclosed embodiments is obtained by, in sequence, heating steel having the component composition described above, performing hot rolling at a rolling reduction in the final pass of a finish rolling of 5% or more and 15% or less and at a finish rolling delivery temperature of 800° C. or higher and 1,000° C. or lower, performing coiling at a coiling temperature of 600° C. or lower, performing cold rolling, and performing annealing, in which letting a temperature defined by formula (1) be temperature Ta (° C.) and letting a temperature defined by formula (2) be temperature Tb (° C.), the annealing includes, in sequence, retaining heat (hereinafter, also referred to as "holding") at a heating temperature of 720° C. or higher and temperature Ta or lower for 10 s or more, performing cooling to a cooling stop temperature of (temperature Tb−100° C.) or higher and temperature Tb or lower at an average cooling rate of 10° C./s or more in a temperature range of 600° C. to the heating temperature, performing reheating to A or higher and 560° C. or lower (where A is a freely-selected temperature (° C.) that satisfies 350° C.≤A≤450° C.), and performing holding at a holding temperature (A) of 350° C. or higher and 450° C. or lower for 10 s or more. After the coiling, a heat treatment that includes performing holding in a heat treatment temperature range of 450° C. to 650° C. for 900 s or more may be performed. The high-strength steel sheet obtained as described above may be subjected to a coating treatment.

Detailed description will be given below. In the description, the expression "° C." relating to temperature refers to a surface temperature of the steel sheet. In the disclosed embodiments, the thickness of the high-strength steel sheet is not particularly limited. Usually, the disclosed embodiments are preferably applied to a high-strength steel sheet having a thickness of 0.3 mm or more and 2.8 mm or less.

In the disclosed embodiments, a method for making steel (steel slab) is not particularly limited, and any known method for making steel using a furnace such as a converter or an electric furnace may be employed. Although a casting process is not particularly limited, a continuous casting process is preferred. The steel slab (slab) is preferably produced by the continuous casting process in order to prevent macrosegregation. However, the steel slab may be produced by, for example, an ingot-making process or a thin slab casting process.

Any of the following processes may be employed in the disclosed embodiments without problem: in addition to a conventional process in which a steel slab is produced, temporarily cooled to room temperature, and reheated; an energy-saving processes such as hot direct rolling and direct rolling in which a hot steel slab is transferred into a heating furnace without cooling to room temperature and is hot-rolled or in which a steel slab is slightly held and then immediately hot-rolled. In the case of hot-rolling the slab, the slab may be reheated to 1,100° C. or higher and 1,300° C. or lower in a heating furnace and then hot-rolled, or may be heated in a heating furnace set at a temperature of 1,100° C. or higher and 1,300° C. or lower for a short time and then hot-rolled. The slab is formed by rough rolling under usual conditions into a sheet bar. In the case where a low heating temperature is used, the sheet bar is preferably heated with, for example, a bar heater before finish rolling from the viewpoint of preventing trouble during hot rolling.

The steel obtained as described above is subjected to hot rolling. The hot rolling may be performed by rolling including rough rolling and finish rolling or by rolling consisting only of finish rolling excluding rough rolling. In this hot rolling, it is important to control the rolling reduction in the final pass of the finish rolling and the finish rolling delivery temperature.

[Rolling Reduction in Final Pass of Finish Rolling: 5% or More and 15% or Less]

In the disclosed embodiments, this is significantly important because the average grain size of ferrite, the average size of martensite, and texture can be appropriately controlled by controlling the rolling reduction in the final pass of the finish rolling. If the rolling reduction in the final pass of the finish rolling is less than 5%, the grain size of the ferrite during the hot rolling is increased to increase the area percentage of the ferrite after the annealing. In other words, the area percentage of the hard phase is decreased to increase the area percentage of fresh martensite, thereby decreasing the ductility. If the rolling reduction in the final pass of the finish rolling is more than 15%, the grain size of the ferrite during the hot rolling is decreased. When the resulting hot-rolled steel sheet is cold-rolled, nucleation sites for austenite are increased during the annealing. This results in a decrease in the area percentage of the ferrite and an increase in the area percentage of the hard phase, thereby increasing TS and decreasing the ductility. Accordingly, the rolling reduction in the final pass of the finish rolling is 5% or more and 15% or less, preferably 6% or more, preferably 14% or less.

[Finish Rolling Delivery Temperature: 800° C. or Higher and 1,000° C. or Lower]

The steel slab that has been heated is subjected to hot rolling including rough rolling and finish rolling into a hot-rolled steel sheet. A finish rolling delivery temperature of higher than 1,000° C. results in a coarse hot-rolled microstructure, thereby increasing the area percentage of the ferrite after the annealing. In other words, the fraction of the hard phase is decreased to increase the area percentage of fresh martensite, thereby decreasing the ductility. Additionally, the amount of oxide (scale) formed is steeply increased to roughen the interface between base iron and the oxide. The surface quality of the steel sheet after the pickling and the cold rolling is degraded. Furthermore, if the scale formed in the hot rolling is partially left on a part after the pickling, the ductility and the hole expansion formability are adversely affected. A finish rolling delivery temperature of lower than 800° C. results in an increase in rolling force, thereby increasing the rolling load. Furthermore, the rolling reduction of the austenite in an unrecrystallized state is increased to decrease the grain size of the ferrite during the hot rolling. When the resulting hot-rolled steel sheet is cold-rolled, nucleation sites for austenite are increased during the annealing. This results in a decrease in the area percentage of the ferrite and an increase in the area percentage of the hard phase, thereby increasing TS and YR and decreasing the ductility. Additionally, the hole expansion formability is degraded. Accordingly, the finish rolling delivery temperature in the hot rolling is 800° C. or higher and 1,000° C. or lower, preferably 820° C. or higher, preferably 950° C. or lower, more preferably 850° C. or higher, more preferably 950° C. or lower.

[Coiling Temperature: 600° C. or Lower]

If the coiling temperature after the hot rolling is higher than 600° C., the steel microstructure of the hot-rolled sheet (hot-rolled steel sheet) has ferrite and pearlite. Because the reverse transformation of austenite during the annealing occurs preferentially from the pearlite, the retained austenite after the annealing has a large average grain size, thereby decreasing the ductility. Additionally, the punching characteristics and the hole expansion formability are degraded. The lower limit of the coiling temperature is not particularly limited. However, if the coiling temperature after the hot rolling is lower than 300° C., the steel microstructure after the hot rolling is single-phase martensite. Thus, when the hot-rolled sheet is cold-rolled, nucleation sites for austenite are increased during the annealing. This results in a decrease in the area percentage of the ferrite and an increase in the area percentage of the hard phase, thereby increasing TS and YR and decreasing the ductility. Thus, the hole expansion formability may be degraded. Additionally, an increase in the strength of the hot-rolled steel sheet increases the rolling load in the cold rolling, thereby possibly decreasing the productivity. Furthermore, when such a hard hot-rolled steel sheet mainly composed of martensite is cold-rolled, fine internal cracks (brittle cracks) in the martensite are easily formed along the grain boundaries of the prior austenite, thereby possibly decreasing the ductility and the stretch-flangeability of the final annealed sheet. Accordingly, the coiling temperature is 600° C. or lower, preferably 300° C. or higher, preferably 570° C. or lower.

Finish rolling may be continuously performed by joining rough-rolled sheets together during the hot rolling. Rough-rolled sheets may be temporarily coiled. To reduce the rolling force during the hot rolling, the finish rolling may be partially or entirely performed by lubrication rolling. The lubrication rolling is also effective from the viewpoint of achieving a uniform shape of the steel sheet and a homogeneous material. When the lubrication rolling is performed, the coefficient of friction is preferably in the range of 0.10 or more and 0.25 or less.

The hot-rolled steel sheet produced as described above can be subjected to pickling. Examples of a method of the pickling include, but are not particularly limited to, pickling with hydrochloric acid and pickling with sulfuric acid. The pickling enables removal of oxide from the surfaces of the steel sheet and thus is effective in ensuring good chemical convertibility and good coating quality of the high-strength steel sheet as the final product. When the pickling is performed, the pickling may be performed once or multiple times.

The thus-obtained sheet that has been subjected to the pickling treatment after the hot rolling is subjected to cold rolling. In the case of performing the cold rolling, the sheet that has been subjected to the pickling treatment after the hot rolling may be subjected to cold rolling as it is or may be subjected to heat treatment and then the cold rolling. The heat treatment may be performed under conditions described below.

[Heat Treatment of Hot-Rolled Steel Sheet After Pickling Treatment: Holding in Temperature Range of 450° C. to 650° C. for 900 s or more] (Preferred Condition)

If a heat treatment temperature range is lower than 450° C. or if a holding time in a heat treatment temperature range is less than 900 s, because of insufficient tempering after the hot rolling, the rolling load is increased in the subsequent cold rolling. Thereby, the steel sheet can fail to be rolled to a desired thickness. Furthermore, because of the occurrence of non-uniform tempering in the microstructure, the reverse transformation of austenite occurs non-uniformly during the annealing after the cold rolling. This coarsens the average grain size of the retained austenite after the annealing, thereby decreasing the ductility. If the heat treatment temperature range is higher than 650° C., a non-uniform microstructure containing ferrite and either martensite or pearlite is obtained, and the reverse transformation of austenite occurs non-uniformly during the annealing after the cold rolling. This coarsens the average grain size of the retained austenite after the annealing, thereby decreasing the ductility. Accordingly, the heat treatment temperature range of the hot-rolled steel sheet after the pickling treatment is preferably in the temperature range of 450° C. to 650° C., and the holding time in the temperature range is preferably 900 s or more. The upper limit of the holding time is not particularly limited. In view of the productivity, the upper limit of the holding time is preferably 36,000 s or less, more preferably 34,000 s or less.

The conditions of the cold rolling are not particularly limited. For example, the cumulative rolling reduction in the cold rolling is preferably about 30% to about 80% in view of the productivity. The number of rolling passes and the rolling reduction of each of the passes are not particularly limited. In any case, the advantageous effects of the disclosed embodiments can be provided.

The resulting cold-rolled steel sheet is subjected to the annealing (heat treatment) described below.

[Heating Temperature: 720° C. or Higher and Temperature Ta or Lower]

If the heating temperature in the annealing step is lower than 720° C., a sufficient area percentage of austenite cannot be ensured during the annealing. Ultimately, each of the desired area percentages of the tempered martensite, the fresh martensite, and the retained austenite cannot be ensured. Thus, it makes it difficult to ensure the strength and a good balance between the strength and the ductility. Furthermore, the hole expansion formability is degraded. If the heating temperature in the annealing step is higher than temperature Ta, the annealing is performed in the temperature range where single-phase austenite is present. Thus, ferrite is not formed in the cooling step, thereby increasing TS and YR and decreasing the ductility. Accordingly, the heating temperature in the annealing step is 720° C. or higher and temperature Ta or lower, preferably 750° C. or higher and temperature Ta or lower.

Here, temperature Ta (° C.) can be calculated by the following formula:

$$\text{temperature Ta (° C.)}=946-203\times[\%\ C]^{1/2}+45\times[\%\ Si]-30\times[\%\ Mn]+150\times[\%\ Al]-20\times[\%\ Cu]+11\times[\%\ Cr]+400\times[\%\ Ti]\ \ldots \quad (1)$$

where [% X] indicates the component element X content (% by mass) of steel and is 0 if X is not contained.

The average heating rate to the heating temperature is not particularly limited. Usually, the average heating rate is preferably 0.5° C./s or more and 50.0° C./s or less.

[Holding Time at Heating Temperature: 10 s or More]

If the holding time in the annealing step is less than 10 s, the cooling is performed while the reverse transformation of austenite does not proceed sufficiently. Ultimately, each of the desired area percentages of the tempered martensite, the fresh martensite, and the retained austenite cannot be ensured. Thus, it makes it difficult to ensure the strength and a good balance between the strength and the ductility. The upper limit of the holding time in the annealing step is not particularly limited. In view of the productivity, the holding time is preferably 600 s or less. Accordingly, the holding time at the heating temperature in the annealing step is 10 s or more, preferably 30 s or more, preferably 600 s or less.

[Average Cooling Rate in Temperature Range of 600° C. to Heating Temperature: 10° C./s or More]

If the average cooling rate in the temperature range of 600° C. to the heating temperature is less than 10° C./s, the coarsening of ferrite and the formation of pearlite occur during the cooling. Ultimately, a desired amount of fine retained austenite is not obtained. Additionally, the C content of the retained austenite is decreased. This makes it difficult to ensure a good balance between the strength and the ductility. The upper limit of the average cooling rate in the temperature range of 600° C. to the heating temperature is not particularly limited. The industrially possible upper limit of the average cooling rate is up to 80° C./s. Accordingly, the average cooling rate in the temperature range of 600° C. to the heating temperature in the annealing step is 10° C./s or more, preferably 12° C./s or more, preferably 80° C./s or less, more preferably 15° C./s or more, more preferably 60° C./s or less.

[Cooling Stop Temperature: (Temperature Tb−100° C.) or Higher and Temperature Tb or Lower]

In the disclosed embodiments, this is a significantly important constituent feature. In this cooling, by cooling to temperature Tb or lower, the amount of bainitic ferrite formed in the holding step after the reheating is markedly increased. If the cooling stop temperature is higher than temperature Tb, the amounts of bainitic ferrite and retained austenite cannot satisfy amounts specified in the disclosed embodiments, thereby decreasing the ductility. Additionally, the area percentage of the fresh martensite is increased to decease the YR and to degrade the hole expansion formability. If the cooling stop temperature is lower than (temperature Tb−100° C.), substantially entire untransformed austenite present during the cooling is subjected to martensitic transformation when the cooling is stopped. Thus, desired amounts of bainitic ferrite and retained austenite cannot be ensured, thereby decreasing the ductility. Additionally, the area percentage of the tempered martensite is increased to increase YR. Accordingly, the cooling stop temperature in the annealing step is (temperature Tb−100° C.) or higher and temperature Tb or lower, preferably (temperature Tb−80° C.) or higher and temperature Tb or lower.

Here, temperature Tb (° C.) can be calculated by the following formula:

$$\text{temperature Tb (° C.)}=435-566\times[\%\ C]-150\times[\%\ C]\times[\%\ Mn]-7.5\times[\%\ Si]+15\times[\%\ Cr]-67.6\times[\%\ C]\times[\%\ Cr]\ \ldots \quad (2)$$

where [% X] indicates the component element X content (% by mass) of steel and is 0 if X is not contained.

In the cooling described above, the average cooling rate in the temperature range of the cooling stop temperature to lower than 600° C. is not particularly limited. Usually, the average cooling rate is 1° C./s or more and 50° C./s or less.

[Reheating Temperature: A or Higher and 560° C. or Lower (Where A is Holding Temperature and Freely-Selected Temperature (° C.) that Satisfies 350° C.≤A≤450° C.)]

This is a significantly important control factor in the disclosed embodiments. Martensite and austenite present during the cooling are reheated to temper the martensite and to diffuse C dissolved in the martensite in a supersaturated state into the austenite, thereby enabling the formation of austenite stable at room temperature. To provide the effect, the reheating temperature needs to be equal to higher than the holding temperature described below. If the reheating temperature is lower than the holding temperature, C does not concentrate in untransformed austenite present during the reheating, and bainite is formed during the subsequent holding, thereby increasing YS and YR. If the reheating temperature is higher than 560° C., the austenite is decomposed into pearlite. Thus, retained austenite is not formed, thereby increasing YR to decrease the ductility. Accordingly, the reheating temperature in the annealing step is the holding temperature (A), which will be described below, or higher and 560° C. or lower, preferably the holding temperature (A) or higher and 530° C. or lower.

The reheating temperature is a temperature equal to or higher than the holding temperature (A) described below. The reheating temperature is preferably 350° C. to 560° C., more preferably 380° C. or higher, more preferably 520° C. or lower, even more preferably 400° C. or higher, even more preferably 450° C. or lower.

[Holding Temperature (A): 350° C. or Higher and 450° C. or Less]

This is a significantly important control factor in the disclosed embodiments. If the holding temperature in the holding step in the annealing step is higher than 450° C., bainitic transformation does not proceed during the holding after the reheating. This makes it difficult to ensure desired amounts of bainitic ferrite and retained austenite, thereby decreasing the ductility. Additionally, the area percentage of the fresh martensite is increased to decrease YR and to degrade the hole expansion formability. If the holding temperature is lower than 350° C., lower bainite is formed preferentially. Thus, a desired amount of retained austenite cannot be ensured, thereby decreasing the ductility. Additionally, mobile dislocation is introduced in ferrite near the interface with the lower bainite when the lower bainite is formed, thereby decreasing YR. Accordingly, the holding temperature (A) in the holding step in the annealing step is 350° C. or higher and 450° C. or lower.

[Holding Time at Holding Temperature: 10 s or More]

If the holding time at the holding temperature in the annealing step is less than 10 s, the cooling is performed while the tempering of martensite present during the reheating does not proceed sufficiently. Thus, the ratio of the C content of tempered martensite to the C content of the fresh martensite is increased. In other words, the difference in hardness between the fresh martensite and the tempered martensite is a comparable level. Thus, a structure having a hardness between the ferrite and the fresh martensite is not present, thereby degrading the hole expansion formability. Additionally, the diffusion of C into untransformed austenite does not proceed sufficiently. Thus, austenite is not left at room temperature to decrease El. The upper limit of the holding time at the holding temperature is not particularly limited. In view of the productivity, the upper limit is preferably 1,000 s or less. Accordingly, the holding time at the holding temperature is 10 s or more, preferably 10 s or more and 1,000 s or less, more preferably 15 s or more, more preferably 700 s or less.

The cooling after the holding at the holding temperature in the annealing step need not be particularly specified. The cooling may be performed to a desired temperature by a freely-selected method. The desired temperature is preferably about room temperature from the viewpoint of preventing oxidation of the surfaces of the steel sheet. The average cooling rate in the cooling is preferably 1 to 50° C./s.

In this way, the high-strength steel sheet of the disclosed embodiments is produced.

The material of the resulting high-strength steel sheet of the disclosed embodiments is not affected by zinc-based coating treatment or the composition of a coating bath, and the advantageous effects of the disclosed embodiments are provided. Thus, coating treatment described below can be performed to provide a coated steel sheet.

The high-strength steel sheet of the disclosed embodiments can be subjected to temper rolling (skin pass rolling). In the case where the temper rolling is performed, if the rolling reduction in the skin pass rolling is more than 2.0%, the yield stress of steel is increased to increase YR. Thus, the rolling reduction is preferably 2.0% or less. The lower limit of the rolling reduction in the skin pass rolling is not particularly limited. In view of the productivity, the lower limit of the rolling reduction is preferably 0.1% or more.

[Coating Treatment] (Preferred Condition)

A method for producing a coated steel sheet of the disclosed embodiments is a method in which a cold-rolled steel sheet (thin steel sheet) is subjected to coating. Examples of the coating treatment include galvanizing treatment and treatment in which alloying is performed after the galvanizing treatment (galvannealing). The annealing and the galvanization may be continuously performed on a single line. A coated layer may be formed by electroplating such as Zn—Ni alloy plating. Hot-dip zinc-aluminum-magnesium alloy coating may be performed. While galvanization is mainly described herein, the type of coating metal such as Zn coating or Al coating is not particularly limited.

For example, in the case where the galvanizing treatment is performed, after the thin steel sheet is subjected to galvanizing treatment by immersing the thin steel sheet in a galvanizing bath having a temperature of 440° C. or higher and 500° C. or lower, the coating weight is adjusted by, for example, gas wiping. At lower than 440° C., zinc is not dissolved, in some cases. At higher than 500° C., the alloying of the coating proceeds excessively, in some cases. In the galvanization, the galvanizing bath having an Al content of 0.10% or more by mass and 0.23% or less by mass is preferably used. An Al content of less than 0.10% by mass can result in the formation of a hard brittle Fe—Zn alloy layer at the coated layer-base iron interface during the galvanization to cause a decrease in the adhesion of the coating and the occurrence of nonuniform appearance. An Al content of more than 0.23% by mass can result in the formation of a thick Fe—Al alloy layer at interface between the coated layer and base iron immediately after the immersion in the galvanizing bath, thereby hindering the formation of a Fe—Zn alloy layer and increasing the alloying temperature to decrease the ductility in some cases. The coating weight is preferably 20 to 80 g/m$^2$ per side. Both sides are coated.

In the case where alloying treatment of the galvanized coating is performed, the alloying treatment of the galvanized coating is performed in the temperature range of 470° C. to 600° C. after the galvanization treatment. At lower than 470° C., the Zn—Fe alloying speed is very low, thereby decreasing the productivity. If the alloying treatment is performed at higher than 600° C., untransformed austenite can be transformed into pearlite to decrease TS. Accordingly, when the alloying treatment of the galvanized coating is performed, the alloying treatment is preferably performed in the temperature range of 470° C. to 600° C., more preferably 470° C. to 560° C. In the galvannealed steel sheet (GA), the Fe concentration in the coated layer is preferably 7% to 15% by mass by performing the alloying treatment.

For example, in the case where electrogalvanizing treatment is performed, a galvanizing bath having a temperature of room temperature or higher and 100° C. or lower is preferably used. The coating weight per side is preferably 20 to 80 g/m$^2$. Both sides are coated.

The conditions of other production methods are not particularly limited. In view of the productivity, a series of treatments such as the annealing, the galvanization, and the alloying treatment of the galvanized coating (galvannealing) are preferably performed on a continuous galvanizing line (CGL), which is a galvanizing line. After the galvanization, wiping can be performed in order to adjust the coating weight. Regarding conditions such as coating other than the conditions described above, the conditions of a commonly used galvanization method can be used.

[Temper Rolling] (Preferred Condition)

In the case where the temper rolling is performed, the rolling reduction in the skin pass rolling after the coating treatment is preferably in the range of 0.1% to 2.0%. If the rolling reduction in the skin pass rolling is less than 0.1%, the effect is low, and it is difficult to control the rolling reduction to the level. Thus, the value is set to the lower limit of the preferred range. If the rolling reduction in the skin pass rolling is more than 2.0%, the productivity is significantly decreased, and YR is increased. Thus, the value is set to the upper limit of the preferred range. The skin pass rolling may be performed on-line or off-line. To achieve an intended rolling reduction, a skin pass may be performed once or multiple times.

EXAMPLES

The operation and advantageous effects of the high-strength steel sheet of the disclosed embodiments and the method for producing the high-strength steel sheet will be described below by examples. The disclosed embodiments are not limited to these examples described below.

Molten steels having component compositions listed in Table 1, the balance being Fe and incidental impurities, were produced in a converter and then formed into steel slabs by a continuous casting process. The resulting steel slabs were heated at 1,250° C. and subjected to hot rolling, coiling, and pickling treatment under conditions listed in Table 2. The hot-rolled sheets of No. 1 to 18, 20, 21, 23, 25, 27, 28, 30 to 35, 37, and 39 presented in Table 2 were subjected to heat treatment under the conditions listed in Table 2.

Then cold rolling was performed at a rolling reduction of 50% to form cold-rolled steel sheets having a thickness of 1.2 mm. The resulting cold-rolled steel sheets were subjected to annealing treatment under the conditions listed in Table 2 to provide high-strength cold-rolled steel sheets (CR). In the annealing treatment, the average heating rate to a heating temperature was 1 to 10° C./s. The average cooling rate from lower than 600° C. to the cooling stop temperature was 5 to 30° C./s. The cooling stop temperature in cooling after holding at a holding temperature was room temperature. The average cooling rate in the cooling was 1 to 10° C./s.

Some high-strength cold-rolled steel sheets (thin steel sheets) (CR) were subjected to galvanizing treatment to provide galvanized steel sheets (GI), galvannealed steel sheets (GA), and electrogalvanized steel sheets (EG). Regarding galvanizing baths, a zinc bath containing Al: 0.14% by mass or 0.19% by mass was used for each GI, and a zinc bath containing Al: 0.14% by mass was used for each GA. The bath temperature thereof was 470° C. GI had a coating weight of 72 g/m$^2$ or 45 g/m$^2$ per side, and both sides thereof were coated. GA had a coating weight of 45 g/m$^2$ per side, and both sides thereof were coated. The coated layers of GA had a Fe concentration of 9% or more by mass and 12% or less by mass. Each EG had Zn—Ni coated layers having a Ni content of 9% or more by mass and 25% or less by mass.

Temperature Ta (° C.) presented in Table 1 was determined by means of formula (1):

$$\text{temperature Ta (° C.)}=946-203\times[\%\ C]^{1/2}+45\times[\%\ Si]-30\times[\%\ Mn]+150\times[\%\ Al]-20\times[\%\ Cu]+11\times[\%\ Cr]+400\times[\%\ Ti]\ \ldots \quad (1)$$

temperature Tb (° C.) presented in Table 1 was determined by means of formula (2):

$$\text{temperature Tb (° C.)}=435-566\times[\%\ C]-150\times[\%\ C]\times[\%\ Mn]-7.5\times[\%\ Si]+15\times[\%\ Cr]-67.6\times[\%\ C]\times[\%\ Cr]\ \ldots \quad (2)$$

where [% X] indicates the component element X content (% by mass) of steel and is calculated as 0 if X is not contained.

TABLE 1

| Type of steel | Component composition (% by mass) | | | | | | | | | | | | | |
|---|---|---|---|---|---|---|---|---|---|---|---|---|---|---|
| | C | Si | Mn | P | S | Al | N | Ti | Nb | V | B | Mo | Cr | Cu |
| A | 0.231 | 1.52 | 2.48 | 0.022 | 0.0034 | 0.043 | 0.0038 | — | — | — | — | — | — | — |
| B | 0.227 | 1.36 | 2.38 | 0.024 | 0.0015 | 0.049 | 0.0038 | — | — | — | — | — | — | — |
| C | 0.209 | 1.57 | 2.21 | 0.015 | 0.0015 | 0.043 | 0.0020 | — | — | — | — | — | — | — |
| D | 0.202 | 1.72 | 2.48 | 0.036 | 0.0025 | 0.021 | 0.0039 | — | — | — | — | — | — | — |
| E | 0.213 | 1.52 | 2.78 | 0.044 | 0.0029 | 0.021 | 0.0032 | — | — | — | — | — | — | — |
| F | 0.163 | 1.34 | 2.56 | 0.023 | 0.0042 | 0.042 | 0.0012 | — | — | — | — | — | — | — |
| G | 0.183 | 1.35 | 2.71 | 0.031 | 0.0050 | 0.030 | 0.0042 | — | — | — | — | — | — | — |
| H | 0.076 | 1.70 | 2.36 | 0.038 | 0.0020 | 0.043 | 0.0010 | — | — | — | — | — | — | — |
| I | 0.201 | 0.78 | 2.79 | 0.018 | 0.0030 | 0.026 | 0.0043 | — | — | — | — | — | — | — |
| J | 0.215 | 1.27 | 1.39 | 0.047 | 0.0010 | 0.030 | 0.0021 | — | — | — | — | — | — | — |
| K | 0.194 | 1.24 | 3.15 | 0.041 | 0.0018 | 0.042 | 0.0046 | — | — | — | — | — | — | — |
| L | 0.193 | 1.59 | 1.86 | 0.050 | 0.0016 | 0.036 | 0.0031 | — | — | — | — | — | — | — |
| M | 0.198 | 1.40 | 1.78 | 0.046 | 0.0037 | 0.039 | 0.0047 | 0.042 | — | — | — | — | — | — |
| N | 0.195 | 1.43 | 2.05 | 0.049 | 0.0042 | 0.037 | 0.0038 | — | 0.038 | — | — | — | — | — |
| O | 0.186 | 1.38 | 2.31 | 0.017 | 0.0030 | 0.031 | 0.0017 | 0.033 | — | — | 0.0014 | — | — | — |
| P | 0.204 | 1.51 | 2.07 | 0.017 | 0.0015 | 0.040 | 0.0013 | — | — | 0.046 | — | — | 0.30 | — |

TABLE 1-continued

| | | | | | | | | | | | | | | |
|---|---|---|---|---|---|---|---|---|---|---|---|---|---|---|
| Q | 0.200 | 1.35 | 2.03 | 0.042 | 0.0024 | 0.024 | 0.0029 | — | — | — | — | 0.038 | — | 0.16 |
| R | 0.215 | 1.49 | 1.94 | 0.033 | 0.0015 | 0.034 | 0.0017 | — | — | — | — | — | — | — |
| S | 0.201 | 1.49 | 2.43 | 0.018 | 0.0028 | 0.027 | 0.0048 | — | — | — | — | — | — | — |
| T | 0.206 | 1.57 | 1.91 | 0.026 | 0.0041 | 0.048 | 0.0039 | — | — | — | — | — | — | — |
| U | 0.203 | 1.37 | 2.50 | 0.049 | 0.0027 | 0.033 | 0.0031 | — | 0.040 | — | — | — | — | — |
| V | 0.208 | 1.32 | 1.89 | 0.005 | 0.0046 | 0.030 | 0.0023 | — | 0.048 | — | — | — | — | — |
| W | 0.200 | 1.72 | 2.35 | 0.005 | 0.0038 | 0.025 | 0.0046 | — | 0.048 | — | — | — | — | — |
| X | 0.217 | 1.14 | 2.43 | 0.018 | 0.0034 | 0.042 | 0.0042 | — | — | — | — | — | — | — |
| Y | 0.233 | 1.39 | 2.16 | 0.030 | 0.0012 | 0.025 | 0.0035 | — | — | — | — | — | — | — |
| Z | 0.165 | 1.34 | 1.92 | 0.027 | 0.0047 | 0.033 | 0.0043 | — | — | — | — | — | — | — |

| Type of steel | Component composition (% by mass) | | | | | | | | | | | Temperature Ta (° C.) | Temperature Tb (° C.) |
|---|---|---|---|---|---|---|---|---|---|---|---|---|---|
| | Ni | As | Sb | Sn | Ta | Ca | Mg | Zn | Co | Zr | REM | | |
| A | — | — | — | — | — | — | — | — | — | — | — | 849 | 207 |
| B | — | — | — | — | — | — | — | — | — | — | — | 847 | 215 |
| C | — | — | — | — | — | — | — | — | — | — | — | 864 | 236 |
| D | — | — | — | — | — | — | — | — | — | — | — | 861 | 233 |
| E | — | — | — | — | — | — | — | — | — | — | — | 841 | 214 |
| F | — | — | — | — | — | — | — | — | — | — | — | 854 | 270 |
| G | — | — | — | — | — | — | — | — | — | — | — | 843 | 247 |
| H | — | — | — | — | — | — | — | — | — | — | — | 902 | 352 |
| I | — | — | — | — | — | — | — | — | — | — | — | 810 | 231 |
| J | — | — | — | — | — | — | — | — | — | — | — | 872 | 259 |
| K | — | — | — | — | — | — | — | — | — | — | — | 824 | 224 |
| L | — | — | — | — | — | — | — | — | — | — | — | 878 | 260 |
| M | — | — | — | — | — | — | — | — | — | — | — | 888 | 259 |
| N | — | — | — | — | — | — | — | — | — | — | — | 865 | 254 |
| O | — | — | — | — | — | — | — | — | — | — | — | 869 | 254 |
| P | — | — | — | — | — | — | — | — | — | — | — | 869 | 245 |
| Q | — | — | — | — | — | — | — | — | — | — | — | 856 | 251 |
| R | 0.38 | — | 0.005 | — | — | — | — | — | — | — | — | 866 | 240 |
| S | — | 0.015 | — | 0.014 | — | — | — | — | — | — | — | 853 | 237 |
| T | — | — | — | — | 0.009 | — | — | — | — | — | — | 874 | 248 |
| U | — | — | 0.010 | — | — | — | — | — | — | — | — | 846 | 233 |
| V | — | — | — | 0.014 | — | — | — | — | — | — | — | 860 | 248 |
| W | — | — | — | — | 0.007 | — | — | — | — | — | — | 866 | 238 |
| X | — | — | — | — | — | 0.0022 | — | — | — | — | — | 836 | 225 |
| Y | — | — | — | — | — | — | 0.0024 | 0.010 | 0.009 | 0.012 | — | 849 | 217 |
| Z | — | — | — | — | — | — | — | — | — | — | 0.0022 | 871 | 284 |

Underlined portions: values are outside the range of the disclosed embodiments.

Note 1:

temperature Ta (° C.) = 946 − 203 × [% C]$^{1/2}$ + 45 × [% Si] − 30 × [% Mn] + 150 × [% Al] − 20 × [% Cu] + 11 × [% Cr] + 400 × [% Ti] . . . (1)

[% X] indicates the component element X content (% by mass) of steel and is 0 is X is not contained.

Note 2:

temperature Tb (° C.) = 435 − 566 × [% C] − 150 × [% C] × [% Mn] − 7.5 × [% Si] + 15 × [% Cr] − 67.6 × [% C] × [% Cr] . . . (2)

[% X] indicates the component element X content (% by mass) of steel and is 0 is X is not contained.

TABLE 2

| | | Hot-rolling treatment | | | Heat treatment of hot-rolled steel sheet | | Annealing treatment | |
|---|---|---|---|---|---|---|---|---|
| No. | Type of steel | Rolling reduction in final pass of finish rolling (%) | Finish rolling delivery temperature (° C.) | Coiling temperature (° C.) | Heat treatment temperature (° C.) | Heat treatment time (s) | Heating temperature (° C.) | Holding time at heating temperature (s) |
| 1 | A | 9 | 910 | 490 | 500 | 14500 | 785 | 280 |
| 2 | B | 11 | 890 | 460 | 520 | 18000 | 810 | 60 |
| 3 | C | 9 | 880 | 525 | 590 | 14200 | 815 | 270 |
| 4 | C | 10 | 780 | 480 | 560 | 14800 | 800 | 90 |
| 5 | C | 11 | 1040 | 500 | 540 | 11000 | 800 | 170 |
| 6 | C | 12 | 910 | 680 | 580 | 24000 | 795 | 280 |
| 7 | C | 9 | 900 | 530 | 580 | 14000 | 875 | 60 |
| 8 | C | 11 | 915 | 510 | 500 | 23800 | 855 | 5 |
| 9 | C | 11 | 900 | 500 | 540 | 11900 | 830 | 75 |
| 10 | C | 10 | 870 | 480 | 525 | 21000 | 795 | 275 |
| 11 | C | 10 | 910 | 450 | 525 | 13800 | 815 | 255 |
| 12 | C | 11 | 880 | 535 | 525 | 15300 | 825 | 215 |
| 13 | C | 11 | 890 | 515 | 525 | 29000 | 820 | 270 |

TABLE 2-continued

| | | | | | | | | |
|---|---|---|---|---|---|---|---|---|
| 14 | C | 11 | 900 | 460 | 530 | 16000 | 815 | 100 |
| 15 | C | 11 | 915 | 535 | 555 | 24500 | 800 | 135 |
| 16 | C | 12 | 930 | 540 | 595 | 17000 | 850 | 145 |
| 17 | D | 11 | 915 | 470 | 550 | 28400 | 815 | 280 |
| 18 | E | 11 | 900 | 470 | 510 | 27400 | 820 | 65 |
| 19 | F | 13 | 940 | 520 | — | — | 820 | 145 |
| 20 | G | 10 | 885 | 570 | 560 | 13000 | 800 | 245 |
| 21 | H | 9 | 885 | 495 | 510 | 2700 | 785 | 120 |
| 22 | I | 9 | 910 | 520 | — | — | 800 | 260 |
| 23 | J | 10 | 900 | 530 | 510 | 19000 | 845 | 110 |
| 24 | K | 11 | 880 | 465 | — | — | 820 | 190 |
| 25 | L | 11 | 890 | 470 | 530 | 27000 | 840 | 580 |
| 26 | M | 10 | 875 | 470 | — | — | 820 | 260 |
| 27 | N | 12 | 910 | 520 | 585 | 22100 | 800 | 270 |
| 28 | O | 9 | 900 | 470 | 510 | 23900 | 830 | 300 |
| 29 | P | 11 | 880 | 470 | — | — | 800 | 210 |
| 30 | Q | 10 | 890 | 500 | 465 | 12400 | 820 | 145 |
| 31 | R | 11 | 910 | 495 | 520 | 24400 | 760 | 35 |
| 32 | S | 12 | 890 | 475 | 600 | 21000 | 790 | 145 |
| 33 | T | 9 | 895 | 480 | 495 | 23000 | 790 | 90 |
| 34 | U | 9 | 925 | 470 | 600 | 18500 | 810 | 265 |
| 35 | V | 11 | 865 | 475 | 580 | 31000 | 800 | 125 |
| 36 | W | 10 | 915 | 400 | — | — | 830 | 150 |
| 37 | X | 7 | 835 | 475 | 560 | 21100 | 800 | 100 |
| 38 | Y | 10 | 905 | 460 | — | — | 820 | 240 |
| 39 | Z | 9 | 915 | 540 | 550 | 23600 | 810 | 175 |

| | Annealing treatment | | | | | |
|---|---|---|---|---|---|---|
| No. | Average cooling rate at 600° C. to heating temperature (° C./s) | Cooling stop temperature (° C.) | Reheating temperature (° C.) | Holding temperature (° C.) | Holding time at holding temperature (s) | Type* |
| 1 | 23 | 175 | 450 | 420 | 440 | CR |
| 2 | 24 | 180 | 430 | 370 | 245 | GI |
| 3 | 21 | 200 | 435 | 370 | 130 | CR |
| 4 | 20 | 205 | 440 | 400 | 480 | CR |
| 5 | 37 | 180 | 405 | 380 | 480 | GA |
| 6 | 38 | 235 | 420 | 410 | 450 | GI |
| 7 | 31 | 215 | 400 | 380 | 240 | CR |
| 8 | 27 | 200 | 430 | 375 | 400 | CR |
| 9 | 8 | 190 | 420 | 395 | 380 | CR |
| 10 | 36 | 120 | 390 | 380 | 480 | EG |
| 11 | 35 | 270 | 440 | 385 | 80 | CR |
| 12 | 22 | 200 | 380 | 400 | 260 | CR |
| 13 | 37 | 215 | 575 | 375 | 260 | CR |
| 14 | 28 | 210 | 420 | 330 | 120 | CR |
| 15 | 18 | 220 | 520 | 510 | 485 | GI |
| 16 | 32 | 200 | 435 | 415 | 6 | CR |
| 17 | 20 | 190 | 400 | 375 | 420 | GA |
| 18 | 31 | 210 | 445 | 390 | 130 | CR |
| 19 | 22 | 195 | 460 | 410 | 415 | CR |
| 20 | 27 | 230 | 420 | 390 | 260 | EG |
| 21 | 18 | 280 | 430 | 400 | 440 | CR |
| 22 | 40 | 200 | 430 | 375 | 480 | GA |
| 23 | 32 | 195 | 455 | 415 | 100 | GI |
| 24 | 21 | 180 | 450 | 430 | 130 | CR |
| 25 | 55 | 205 | 445 | 380 | 430 | CR |
| 26 | 35 | 240 | 435 | 420 | 110 | EG |
| 27 | 38 | 250 | 440 | 410 | 400 | GA |
| 28 | 29 | 210 | 530 | 430 | 420 | CR |
| 29 | 21 | 200 | 460 | 375 | 650 | GA |
| 30 | 23 | 230 | 440 | 370 | 380 | CR |
| 31 | 16 | 210 | 440 | 425 | 330 | GI |
| 32 | 24 | 190 | 455 | 400 | 400 | GA |
| 33 | 32 | 220 | 450 | 415 | 15 | GA |
| 34 | 27 | 190 | 355 | 355 | 320 | CR |
| 35 | 19 | 175 | 440 | 430 | 380 | EG |
| 36 | 38 | 200 | 430 | 390 | 65 | CR |
| 37 | 34 | 190 | 420 | 400 | 255 | GA |
| 38 | 30 | 180 | 390 | 380 | 360 | GI |
| 39 | 25 | 240 | 400 | 390 | 250 | CR |

Underlined portions: values are outside the range of the disclosed embodiments.

(*)CR: cold-rolled steel sheet (uncoated), GI: galvanized steel sheet (without alloying treatment of zinc coating), GA: galvannealed steel sheet, EG: electrogalvanized steel sheet (Zn-Ni alloy coating)

The high-strength cold-rolled steel sheets (CR), the galvanized steel sheets (GI), the galvannealed steel sheets (GA), and the electrogalvanized steel sheets (EG) obtained as described above were used as steel samples for evaluation of mechanical characteristics. The mechanical characteristics were evaluated by performing the quantitative evaluation of constituent microstructures of the steel sheets, a tensile test, and a hole expanding test described below. Table 3 presents the results. Table 3 also presents the thicknesses of the steel sheets serving as the steel samples.

Area Percentage of Each Structure with Respect to Entire Microstructure of Steel Sheet A method for measuring area percentages of ferrite, bainitic ferrite, tempered martensite, fresh martensite, and retained austenite is as follows: A test piece was cut out from each steel sheet in such a manner that a section of the test piece in the sheet-thickness direction, the section being parallel to the rolling direction, was an observation surface. The observation surface was subjected to mirror polishing with a diamond paste, final polishing with colloidal silica, and etching with 3% by volume nital to expose the microstructure. Three fields of view were observed with a scanning electron microscope (SEM) equipped with an in-lens detector at an acceleration voltage of 1 kV and a magnification of ×10,000. From the resulting microstructure images, area percentages of constituent structures (the ferrite, the bainitic ferrite, the tempered martensite, the fresh martensite, and retained austenite) were calculated for the three fields of view using Adobe Photoshop available from Adobe Systems Inc. The resultant values were averaged to determine the area percentage of each structure. In the microstructure images, the ferrite is a base structure that appears as a recessed portion. The bainitic ferrite is a structure that appears as a recessed portion in a hard phase. The tempered martensite is a structure that appears as a recessed portion in the hard phase and that contains fine carbide. The fresh martensite is a structure that appears as a protruding portion in the hard phase and that has fine irregularities therein. The retained austenite is a structure that appears as a protruding portion in the hard phase and that is flat therein. In Table 3, F denotes ferrite. BF denotes bainitic ferrite. TM denotes tempered martensite. FM denotes fresh martensite. RA denotes retained austenite.

Average Grain Size of Retained Austenite

A method for measuring the average grain size of the retained austenite is as follows: A test piece is cut out in such a manner that a section of the test piece in the sheet-thickness direction of each steel sheet, the section being parallel to the rolling direction, is an observation surface. The observation surface is subjected to mirror polishing with a diamond paste, final polishing with colloidal silica, and etching with 3% by volume nital to expose the microstructure. Three fields of view were observed with a SEM equipped with an in-lens detector at an acceleration voltage of 1 kV and a magnification of ×10,000. From the resulting microstructure images, the average grain sizes of the retained austenite are calculated for the three fields of view using Adobe Photoshop available from Adobe Systems Inc. The resultant values are averaged to determine the average grain size of the retained austenite. In the microstructure images, the retained austenite is a structure that appears as a protruding portion in the hard phase and that is flat therein, as described above.

C Content of Retained Austenite, C Content of Tempered Martensite, and C Content of Fresh Martensite A method for measuring the C contents of retained austenite, tempered martensite, and fresh martensite is as follows: A test piece is cut out in such a manner that a section of the test piece in the sheet-thickness direction of each steel sheet, the section being parallel to the rolling direction, is an observation surface. The observation surface is subjected to polishing with a diamond paste and then final polishing with alumina. Three fields of view, each measuring 22.5 μm×22.5 μm, were measured with an electron probe microanalyzer (EPMA) using measurement points spaced at 80 nm intervals at an acceleration voltage of 7 kV. The measured data sets are converted into C concentrations by a calibration curve method. Retained austenite, tempered martensite, and fresh martensite are determined by comparison with SEM images simultaneously acquired using an in-lens detector. The average C contents of the retained austenite, the tempered martensite, and the fresh martensite in the fields of view are calculated for the three fields of view. The resultant values are averaged to determine the C contents thereof. The resulting values were used as the C content of the retained austenite, the C content of the tempered martensite, and the C content of the fresh martensite.

Mechanical Characteristics

A method for measuring the mechanical characteristics (tensile strength TS, yield stress YS, and total elongation El) is as follows: A tensile test was performed in accordance with JIS Z 2241(2011) using JIS No. 5 test pieces that were sampled in such a manner that the longitudinal directions of each test piece coincided with a direction (C-direction) perpendicular to the rolling direction of the steel sheets, to measure the yield stress (YS), the tensile strength (TS), and the total elongation (El). In the disclosed embodiments, the case where TS was 980 MPa or more was evaluated as good. The case where the value of the yield ratio YR (=YS/TS)×100, which serves as an index of the controllability of YS, was 55% or more and 75% or less was evaluated as good. The term "good ductility", i.e., "good total elongation (El)", indicates that in the case where the balance between the strength and the workability (ductility) was evaluated by calculating the product of the tensile strength and the total elongation (TS×El), the value of TS×El was 23,500 MPa·% or more, which was evaluated as good.

A hole expanding test was performed in accordance with JIS Z 2256(2010). Each of the resulting steel sheets was cut into a piece measuring 100 mm×100 mm. A hole having a diameter of 10 mm was formed in the piece by punching at a clearance of 12%±1%. A cone punch with a 60° apex was forced into the hole while the piece was fixed with a die having an inner diameter of 75 mm at a blank-holding pressure of 9 tons (88.26 kN). The hole diameter at the crack initiation limit was measured. The critical hole-expansion ratio λ (%) was determined from a formula described below. The hole expansion formability was evaluated on the basis of the value of the critical hole-expansion ratio.

$$\text{Critical hole-expansion ratio: } \lambda\ (\%)=\{(D_f-D_o)/D_o\}\times 100$$

where $D_f$ is the hole diameter (mm) when a crack is initiated, and $D_o$ is the initial hole diameter (mm). The test was performed three times for each steel sheet. The average hole expansion ratio (λ %) was determined to evaluate the stretch-flangeability. The term "good stretch-flangeability" used in the disclosed embodiments indicates that in the case where the balance between the strength and the stretch-flangeability was evaluated by calculating the product (TS×λ) of the tensile strength and the critical hole-expansion ratio λ, which serves as an index of the stretch-flangeability, the value of TS×λ was 24,500 MPa·% or more, which was evaluated as good.

The residual microstructure was also examined in a general way and presented in Table 3.

TABLE 3

| No. | Type of steel | Area percentage of F (%) | Area percentage of hard phase (%) | Area percentage of BF with respect to entire hard phase (%) | Area percentage of TM with respect to entire hard phase (%) | Area percentage of FM with respect to entire hard phase (%) | Area percentage of RA with respect to entire hard phase (%) | Average grain size of RA (μm) | C content of RA (% by mass) | Ratio of C content of TM to C content of FM |
|---|---|---|---|---|---|---|---|---|---|---|
| 1 | A | 25.4 | 73.0 | 41.3 | 39.9 | 9.3 | 9.5 | 0.3 | 1.5 | 0.3 |
| 2 | B | 26.0 | 72.5 | 40.7 | 38.4 | 11.8 | 9.2 | 0.4 | 1.2 | 0.3 |
| 3 | C | 37.3 | 60.7 | 42.4 | 36.8 | 8.9 | 12.0 | 1.1 | 0.9 | 0.5 |
| 4 | C | 42.6 | 56.3 | 45.7 | 39.6 | 5.4 | 9.3 | 0.6 | 0.9 | 0.7 |
| 5 | C | 35.8 | 61.9 | 42.3 | 37.3 | 9.5 | 11.0 | 1.3 | 1.0 | 0.5 |
| 6 | C | 40.7 | 56.2 | 44.4 | 39.6 | 5.6 | 10.5 | 0.8 | 1.0 | 0.7 |
| 7 | C | 41.2 | 57.6 | 44.0 | 39.4 | 6.6 | 10.0 | 0.8 | 1.0 | 0.6 |
| 8 | C | 43.8 | 54.6 | 43.6 | 39.5 | 5.6 | 11.3 | 0.9 | 1.1 | 0.7 |
| 9 | C | 33.4 | 59.3 | 44.7 | 39.2 | 6.3 | 9.8 | 1.1 | 1.0 | 0.6 |
| 10 | C | 30.6 | 67.3 | 41.8 | 39.9 | 8.7 | 9.7 | 1.1 | 0.9 | 0.6 |
| 11 | C | 39.5 | 59.3 | 44.5 | 36.3 | 7.4 | 11.8 | 1.0 | 0.8 | 0.5 |
| 12 | C | 43.8 | 54.3 | 43.8 | 39.9 | 6.4 | 10.0 | 0.7 | 1.0 | 0.6 |
| 13 | C | 44.1 | 53.0 | 40.5 | 38.8 | 9.5 | 11.2 | 1.4 | 1.1 | 0.5 |
| 14 | C | 38.6 | 60.0 | 43.0 | 39.3 | 8.5 | 9.3 | 1.1 | 0.9 | 0.8 |
| 15 | C | 32.4 | 66.4 | 44.3 | 39.2 | 7.2 | 9.3 | 1.2 | 1.1 | 0.4 |
| 16 | C | 39.6 | 58.2 | 42.5 | 39.2 | 7.4 | 10.9 | 1.1 | 0.9 | 0.3 |
| 17 | D | 45.2 | 53.2 | 42.9 | 31.1 | 11.5 | 14.6 | 1.5 | 1.2 | 0.5 |
| 18 | E | 22.0 | 77.0 | 36.4 | 39.9 | 14.8 | 8.9 | 0.1 | 0.7 | 0.2 |
| 19 | F | 38.9 | 59.9 | 43.7 | 39.7 | 7.1 | 9.5 | 0.8 | 1.1 | 0.7 |
| 20 | G | 35.5 | 61.7 | 42.4 | 39.8 | 6.0 | 11.8 | 0.6 | 1.0 | 0.4 |
| 21 | H | 69.2 | 29.8 | 61.5 | 36.2 | 0.3 | 1.9 | 0.1 | 0.3 | 0.3 |
| 22 | I | 31.2 | 67.4 | 27.6 | 68.1 | 1.5 | 2.9 | 0.1 | 0.3 | 1.0 |
| 23 | J | 69.5 | 28.2 | 62.5 | 23.8 | 1.0 | 12.7 | 5.9 | 1.4 | 1.0 |
| 24 | K | 11.8 | 86.7 | 27.8 | 49.9 | 19.4 | 2.9 | 0.1 | 0.5 | 0.3 |
| 25 | L | 48.9 | 49.0 | 49.8 | 29.9 | 4.8 | 15.5 | 1.7 | 1.4 | 0.8 |
| 26 | M | 45.1 | 53.2 | 46.1 | 36.5 | 4.7 | 12.7 | 1.8 | 1.4 | 0.9 |
| 27 | N | 38.6 | 59.2 | 41.4 | 39.8 | 8.8 | 10.0 | 0.6 | 1.0 | 0.5 |
| 28 | O | 31.2 | 65.9 | 44.8 | 38.0 | 5.4 | 11.9 | 0.6 | 0.9 | 0.6 |
| 29 | P | 30.8 | 67.1 | 42.9 | 35.9 | 9.4 | 11.8 | 1.2 | 0.8 | 0.5 |
| 30 | Q | 41.9 | 57.2 | 45.5 | 39.7 | 5.4 | 9.3 | 0.6 | 0.9 | 0.5 |
| 31 | R | 34.5 | 63.9 | 43.5 | 37.1 | 9.7 | 9.7 | 1.2 | 0.8 | 0.7 |
| 32 | S | 35.4 | 61.9 | 44.3 | 39.0 | 7.2 | 9.4 | 0.7 | 0.9 | 0.4 |
| 33 | T | 38.7 | 59.1 | 44.7 | 39.7 | 5.6 | 10.1 | 1.3 | 1.0 | 0.4 |
| 34 | U | 28.6 | 68.9 | 40.2 | 39.9 | 11.2 | 8.7 | 0.3 | 0.7 | 0.3 |
| 35 | V | 45.4 | 52.7 | 49.5 | 26.8 | 8.5 | 15.2 | 1.8 | 1.2 | 0.9 |
| 36 | W | 46.6 | 52.1 | 40.0 | 32.9 | 11.8 | 15.3 | 1.7 | 1.2 | 0.7 |
| 37 | X | 36.3 | 61.9 | 40.2 | 39.7 | 9.7 | 10.4 | 0.4 | 0.7 | 0.8 |
| 38 | Y | 28.2 | 69.4 | 40.3 | 39.9 | 10.6 | 9.2 | 0.1 | 1.4 | 0.2 |
| 39 | Z | 48.3 | 50.5 | 49.2 | 38.3 | 4.0 | 8.6 | 0.5 | 0.6 | 0.3 |

| No. | Residual micro-structure | YS (MPa) | TS (MPa) | YR (%) | El (%) | TS × El (MPa · %) | λ (%) | TS × λ (MPa · %) | Remarks |
|---|---|---|---|---|---|---|---|---|---|
| 1 | θ | 604 | 1098 | 55 | 21.6 | 23717 | 23 | 25254 | Example |
| 2 | θ | 608 | 1086 | 56 | 21.7 | 23566 | 23 | 24978 | Example |
| 3 | θ | 738 | 1069 | 69 | 24.8 | 26511 | 28 | 29932 | Example |
| 4 | θ | 999 | 1298 | 77 | 15.9 | 20638 | 14 | 18172 | Comparative example |
| 5 | θ | 649 | 1046 | 62 | 19.7 | 20606 | 19 | 19874 | Comparative example |
| 6 | θ | 668 | 1078 | 62 | 19.0 | 20482 | 17 | 18326 | Comparative example |
| 7 | θ | 1123 | 1276 | 88 | 9.9 | 12632 | 60 | 76560 | Comparative example |
| 8 | θ | 555 | 1047 | 53 | 19.0 | 19893 | 19 | 19893 | Comparative example |
| 9 | P + θ | 795 | 1006 | 79 | 19.0 | 19114 | 32 | 32192 | Comparative example |
| 10 | θ | 875 | 1042 | 84 | 20.0 | 20840 | 33 | 34386 | Comparative example |
| 11 | θ | 980 | 1240 | 79 | 15.6 | 19344 | 17 | 21080 | Comparative example |
| 12 | θ | 846 | 1058 | 80 | 20.0 | 21160 | 25 | 26450 | Comparative example |
| 13 | θ | 857 | 1071 | 80 | 19.4 | 20777 | 32 | 34272 | Comparative example |
| 14 | θ | 644 | 1262 | 51 | 16.6 | 20949 | 16 | 20192 | Comparative example |

TABLE 3-continued

| | | | | | | | | | |
|---|---|---|---|---|---|---|---|---|---|
| 15 | θ | 660 | 1269 | 52 | 16.3 | 20685 | 15 | 19035 | Comparative example |
| 16 | θ | 751 | 1212 | 62 | 17.0 | 20604 | 15 | 18180 | Comparative example |
| 17 | θ | 617 | 1029 | 60 | 25.6 | 26342 | 24 | 24696 | Example |
| 18 | θ | 608 | 1086 | 56 | 22.8 | 24761 | 27 | 29322 | Example |
| 19 | θ | 611 | 1053 | 58 | 22.4 | 23587 | 25 | 26325 | Example |
| 20 | θ | 695 | 1007 | 69 | 24.7 | 24873 | 25 | 25175 | Example |
| 21 | θ | 746 | 956 | 78 | 21.9 | 20936 | 31 | 29636 | Comparative example |
| 22 | θ | 763 | 954 | 80 | 20.6 | 19652 | 31 | 29574 | Comparative example |
| 23 | θ | 842 | 1027 | 82 | 19.1 | 19616 | 28 | 28756 | Comparative example |
| 24 | θ | 636 | 1248 | 51 | 15.2 | 18970 | 22 | 27456 | Comparative example |
| 25 | θ | 800 | 1081 | 74 | 23.1 | 24971 | 33 | 35673 | Example |
| 26 | θ | 744 | 1048 | 71 | 22.7 | 23790 | 26 | 27248 | Example |
| 27 | θ | 669 | 999 | 67 | 27.4 | 27373 | 36 | 35964 | Example |
| 28 | P + θ | 709 | 998 | 71 | 24.5 | 24451 | 37 | 36926 | Example |
| 29 | θ | 706 | 994 | 71 | 27.6 | 27434 | 34 | 33796 | Example |
| 30 | θ | 654 | 1038 | 63 | 24.1 | 25016 | 27 | 28026 | Example |
| 31 | θ | 559 | 981 | 57 | 24.8 | 24329 | 26 | 25506 | Example |
| 32 | θ | 675 | 1022 | 66 | 24.5 | 25039 | 29 | 29638 | Example |
| 33 | θ | 743 | 1092 | 68 | 21.9 | 23915 | 24 | 26208 | Example |
| 34 | θ | 633 | 1091 | 58 | 21.8 | 23784 | 31 | 33821 | Example |
| 35 | θ | 723 | 1019 | 71 | 24.2 | 24660 | 38 | 38722 | Example |
| 36 | θ | 714 | 1099 | 65 | 21.4 | 23519 | 23 | 25277 | Example |
| 37 | θ | 742 | 1017 | 73 | 23.8 | 24205 | 25 | 25425 | Example |
| 38 | θ | 653 | 1088 | 60 | 22.8 | 24806 | 23 | 25024 | Example |
| 39 | θ | 729 | 985 | 74 | 24.7 | 24330 | 33 | 32505 | Example |

Underlined portions: values are outside the range of the disclosed embodiments.
F: ferrite, BF: bainitic ferrite, TM: tempered martensite, FM: fresh martensite, RA: retained austenite, P: pearlite, θ: cementite As is clear from Table 3, in these examples, the tensile strength (TS) is 980 MPa or more, the yield ratio (YR) is 55% to 75%, the value of TS×El is 23,500 MPa·% or more, and the value of TS×λ is 24,500 MPa·% or more. That is, the high-strength steel sheets having good ductility and good stretch-flangeability are provided. In contrast, in the steel sheets of comparative examples, which are outside the scope of the disclosed embodiments, as is clear from the examples, one or more of TS, YR, TS×El, and TS×λ cannot satisfy the target performance.

Although some embodiments of the disclosed embodiments have been described above, these embodiments are not intended to be limited by the description that forms part of the present disclosure in relation to the embodiments. That is, a person skilled in the art may make various modifications to the embodiments, examples, and operation techniques disclosed herein, and all such modifications will still fall within the scope of the disclosed embodiments. For example, in the above-described series of heat treatment processes in the production method disclosed herein, any apparatus or the like may be used to perform the processes on the steel sheet as long as the thermal hysteresis conditions are satisfied.

INDUSTRIAL APPLICABILITY

According to the disclosed embodiments, it is possible to produce a high-strength steel sheet having a tensile strength (TS) of 980 MPa or more, a yield ratio (YR) of 55% to 75%, good ductility, and good stretch-flangeability. The use of the high-strength steel sheet, obtained by the production method of the disclosed embodiments, for, for example, automotive structural members reduces the weight of automobile bodies to improve fuel economy; thus, the high-strength steel sheet has a very high industrial utility value.

The invention claimed is:

1. A high-strength steel sheet having a chemical composition comprising, by mass %:

C: 0.12% or more and 0.28% or less,

Si: 0.80% or more and 2.20% or less,

Mn: 1.50% or more and 3.00% or less,

P: 0.001% or more and 0.100% or less,

S: 0.0200% or less,

Al: 0.010% or more and 1.000% or less,

N: 0.0005% or more and 0.0100% or less, and the balance being Fe and incidental impurities, wherein the steel sheet has a steel microstructure comprising in a range of 20.0% or more and 60.0% or less ferrite in terms of area percentage, and in a range of 40.0% or more and 80.0% or less of a hard phase in terms of total area percentage, the hard phase comprising:

in a range of 35.0% or more and 55.0% or less bainitic ferrite in terms of area percentage, in a range of 20.0% or more and 40.0% or less tempered martensite in terms of area percentage, in a range of 3.0% or more and 15.0% or less fresh martensite in terms of area percentage, and in a range of 5.0% or more and 20.0% or less retained austenite in terms of area percentage, the retained austenite has a C content of 0.6% or more by mass, a ratio of a C content of the tempered martensite to a C content of the fresh martensite is in a range of 0.2 or more and less than 1.0, and the steel sheet has a tensile strength (TS) of 980 MPa or more and a yield ratio (YR) in a range of 55% to 75%, where a product (TS×El) of the tensile strength (TS) and a total elongation (El) is 23,500 MPa·% or more, and a product (TS×λ) of the tensile strength (TS) and a hole expansion ratio (λ) is 24,500 MPa·% or more.

2. The high-strength steel sheet according to claim 1, wherein in the steel microstructure, the retained austenite has an average grain size in a range of 0.2 μm or more and 5.0 μm or less.

3. The high-strength steel sheet according to claim 1, wherein the chemical composition further comprises, by mass %, at least one selected from the group consisting of:

Ti: 0.001% or more and 0.100% or less,
Nb: 0.001% or more and 0.100% or less,
V: 0.001% or more and 0.100% or less,
B: 0.0001% or more and 0.0100% or less,
Mo: 0.01% or more and 0.50% or less,
Cr: 0.01% or more and 1.00% or less,
Cu: 0.01% or more and 1.00% or less,
Ni: 0.01% or more and 0.50% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

4. The high-strength steel sheet according to claim 1, further comprising a coated layer disposed on a surface of the steel sheet.

5. A method for producing the high-strength steel sheet according to claim 1, the method comprising, in sequence:

heating steel;

performing hot rolling at a rolling reduction in a final pass of a finish rolling in a range of 5% or more and 15% or less and at a finish rolling delivery temperature in a range of 800° C. or higher and 1,000° C. or lower;

performing coiling at a coiling temperature of 600° C. or lower;

performing cold rolling; and performing annealing by letting a temperature defined by formula (1) be temperature Ta (° C.) and letting a temperature defined by formula (2) be temperature Tb (° C.):

$$\text{temperature Ta (° C.)}=946-203\times[\%\ C]^{1/2}+45\times[\%\ Si]-30\times[\%\ Mn]+150\times[\%\ Al]-20\times[\%\ Cu]+11\times[\%\ Cr]+400\times[\%\ Ti]\ \ldots \quad (1)$$

where [% X] indicates the component element X content (% by mass) of steel and is 0 if X is not contained, and $$\text{temperature Tb (° C.)}=435-566\times[\%\ C]-150\times[\%\ C]\times[\%\ Mn]-7.5\times[\%\ Si]+15\times[\%\ Cr]-67.6\times[\%\ C]\times[\%\ Cr]\ \ldots \quad (2)$$

where [% X] indicates the component element X content (% by mass) of steel and is 0 if X is not contained, wherein the annealing includes, in sequence:

retaining at a heating temperature in a range of 720° C. or higher and temperature Ta or lower for 10 s or more, performing cooling to a cooling stop temperature in a range of (temperature Tb—100° C.) or higher and temperature Tb or lower at an average cooling rate of 10° C./s or more in a temperature range of 600° C. to the heating temperature, performing reheating to in a range of A or higher and 560° C. or lower, where A is a freely-selected temperature (° C.) that satisfies 350° C.≤A≤450° C., and performing holding at the temperature A for 10 s or more.

6. The method for producing the high-strength steel sheet according to claim 5, wherein after the coiling, a heat treatment that includes performing holding in a heat treatment temperature in a range of 450° C. to 650° C. for 900 s or more is performed.

7. The method for producing the high-strength steel sheet according to claim 6, wherein a coating treatment is performed after the annealing.

8. The high-strength steel sheet according to claim 2, wherein the chemical composition further comprises, by mass %, at least one selected from the group consisting of:

Ti: 0.001% or more and 0.100% or less,
Nb: 0.001% or more and 0.100% or less,
V: 0.001% or more and 0.100% or less,
B: 0.0001% or more and 0.0100% or less,
Mo: 0.01% or more and 0.50% or less,
Cr: 0.01% or more and 1.00% or less,
Cu: 0.01% or more and 1.00% or less,
Ni: 0.01% or more and 0.50% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

9. The high-strength steel sheet according to claim 2, further comprising a coated layer disposed on a surface of the steel sheet.

10. The high-strength steel sheet according to claim 3, further comprising a coated layer disposed on a surface of the steel sheet.

11. The high-strength steel sheet according to claim 8, further comprising a coated layer disposed on a surface of the steel sheet.

12. A method for producing the high-strength steel sheet according to claim 2, the method comprising, in sequence:

heating steel;

performing hot rolling at a rolling reduction in a final pass of a finish rolling in a range of 5% or more and 15% or less and at a finish rolling delivery temperature in a range of 800° C. or higher and 1,000° C. or lower;

performing coiling at a coiling temperature of 600° C. or lower;

performing cold rolling; and performing annealing by letting a temperature defined by formula (1) be temperature Ta (° C.) and letting a temperature defined by formula (2) be temperature Tb (° C.):

$$\text{temperature Ta (° C.)}=946-203\times[\%\ C]^{1/2}+45\times[\%\ Si]-30\times[\%\ Mn]+150\times[\%\ Al]-20\times[\%\ Cu]+11\times[\%\ Cr]+400\times[\%\ Ti]\ \ldots \quad (1)$$

where [% X] indicates the component element X content (% by mass) of steel and is 0 if X is not contained, and $$\text{temperature Tb (° C.)}=435-566\times[\%\ C]-150\times[\%\ C]\times[\%\ Mn]-7.5\times[\%\ Si]+15\times[\%\ Cr]-67.6\times[\%\ C]\times[\%\ Cr]\ \ldots \quad (2)$$

where [% X] indicates the component element X content (% by mass) of steel and is 0 if X is not contained, wherein the annealing includes, in sequence:

retaining at a heating temperature in a range of 720° C. or higher and temperature Ta or lower for 10 s or more, performing cooling to a cooling stop temperature in a range of (temperature Tb—100° C.) or higher and temperature Tb or lower at an average cooling rate of 10° C./s or more in a temperature range of 600° C. to the heating temperature, performing reheating to in a range of A or higher and 560° C. or lower, where A is a freely-selected temperature (° C.) that satisfies 350° C.≤A≤450° C., and performing holding at the temperature A for 10 s or more.

13. A method for producing the high-strength steel sheet according to claim 3, the method comprising, in sequence:

heating steel;

performing hot rolling at a rolling reduction in a final pass of a finish rolling in a range of 5% or more and 15% or less and at a finish rolling delivery temperature in a range of 800° C. or higher and 1,000° C. or lower;

performing coiling at a coiling temperature of 600° C. or lower;

performing cold rolling; and performing annealing by letting a temperature defined by formula (1) be temperature Ta (° C.) and letting a temperature defined by formula (2) be temperature Tb (° C.):

$$\text{temperature Ta (° C.)}=946-203\times[\%\ C]^{1/2}+45\times[\%\ Si]-30\times[\%\ Mn]+150\times[\%\ Al]-20\times[\%\ Cu]+11\times[\%\ Cr]+400\times[\%\ Ti]\ \ldots \quad (1)$$

where [% X] indicates the component element X content (% by mass) of steel and is 0 if X is not contained, and $$\text{temperature Tb (° C.)}=435-566\times[\%\ C]-150\times[\%\ C]\times[\%\ Mn]-7.5\times[\%\ Si]+15\times[\%\ Cr]-67.6\times[\%\ C]\times[\%\ Cr]\ \ldots \quad (2)$$

where [% X] indicates the component element X content (% by mass) of steel and is 0 if X is not contained, wherein the annealing includes, in sequence:

retaining at a heating temperature in a range of 720° C. or higher and temperature Ta or lower for 10 s or more, performing cooling to a cooling stop temperature in a range of (temperature Tb—100° C.) or higher and temperature Tb or lower at an average cooling rate of 10° C./s or more in a temperature range of 600° C. to the heating temperature, performing reheating to in a range of A or higher and 560° C. or lower, where A is a freely-selected temperature (° C.) that satisfies 350° C.≤A≤450° C., and performing holding at the temperature A for 10 s or more.

14. A method for producing the high-strength steel sheet according to claim 8, the method comprising, in sequence:

heating steel;

performing hot rolling at a rolling reduction in a final pass of a finish rolling in a range of 5% or more and 15% or less and at a finish rolling delivery temperature in a range of 800° C. or higher and 1,000° C. or lower;

performing coiling at a coiling temperature of 600° C. or lower;

performing cold rolling; and performing annealing by letting a temperature defined by formula (1) be temperature Ta (° C.) and letting a temperature defined by formula (2) be temperature Tb (° C.):

$$\text{temperature Ta (° C.)}=946-203\times[\%\ C]^{1/2}+45\times[\%\ Si]-30\times[\%\ Mn]+150\times[\%\ Al]-20\times[\%\ Cu]+11\times[\%\ Cr]+400\times[\%\ Ti]\ \ldots \quad (1)$$

where [% X] indicates the component element X content (% by mass) of steel and is 0 if X is not contained, and $$\text{temperature Tb (° C.)}=435-566\times[\%\ C]-150\times[\%\ C]\times[\%\ Mn]-7.5\times[\%\ Si]+15\times[\%\ Cr]-67.6\times[\%\ C]\times[\%\ Cr]\ \ldots \quad (2)$$

where [% X] indicates the component element X content (% by mass) of steel and is 0 if X is not contained, wherein the annealing includes, in sequence:

retaining at a heating temperature in a range of 720° C. or higher and temperature Ta or lower for 10 s or more, performing cooling to a cooling stop temperature in a range of (temperature Tb—100° C.) or higher and temperature Tb or lower at an average cooling rate of 10° C./s or more in a temperature range of 600° C. to the heating temperature, performing reheating to in a range of A or higher and 560° C. or lower, where A is a freely-selected temperature (° C.) that satisfies 350° C.≤A≤450° C., and performing holding at the temperature A for 10 s or more.

15. The method for producing the high-strength steel sheet according to claim 12, wherein after the coiling, a heat treatment that includes performing holding in a heat treatment temperature in a range of 450° C. to 650° C. for 900 s or more is performed.

16. The method for producing the high-strength steel sheet according to claim 13, wherein after the coiling, a heat treatment that includes performing holding in a heat treatment temperature in a range of 450° C. to 650° C. for 900 s or more is performed.

17. The method for producing the high-strength steel sheet according to claim 14, wherein after the coiling, a heat treatment that includes performing holding in a heat treatment temperature in a range of 450° C. to 650° C. for 900 s or more is performed.

18. The method for producing the high-strength steel sheet according to claim 15, wherein a coating treatment is performed after the annealing.

19. The method for producing the high-strength steel sheet according to claim 16, wherein a coating treatment is performed after the annealing.

20. The method for producing the high-strength steel sheet according to claim 17, wherein a coating treatment is performed after the annealing.

* * * * *